US005799361A

United States Patent [19]

Reed et al.

[11] Patent Number: 5,799,361

[45] Date of Patent: Sep. 1, 1998

[54] CLEANING SOLUTION APPLICATOR

[75] Inventors: Gary A. Reed, Massillon; Kenneth L. Symensma, Canton, both of Ohio

[73] Assignee: The Hoover Company, North Canton, Ohio

[21] Appl. No.: 703,397

[22] Filed: Aug. 26, 1996

Related U.S. Application Data

[63] Continuation of Ser. No. 183,287, Jan. 14, 1994, Pat. No. 5,548,866.

[51] Int. Cl.[6] ..... A47L 11/30

[52] U.S. Cl. ..... 15/320; 15/345; 239/423; 239/754

[58] Field of Search ..... 15/320, 321, 322, 15/345; 239/423, 590.3, 590.5, 754

[56] References Cited

U.S. PATENT DOCUMENTS

| | | | |
|---|---|---|---|
| 2,270,579 | 1/1942 | Chamberlin et al. | 15/322 X |
| 2,986,764 | 6/1961 | Krammes | 15/320 |
| 3,048,876 | 8/1962 | Kemnitz | 15/321 |
| 3,199,789 | 8/1965 | James | 239/423 |
| 3,840,935 | 10/1974 | Fitzgerald et al. | 15/322 |
| 3,964,925 | 6/1976 | Burgoon | 15/322 X |
| 4,712,740 | 12/1987 | Duncan et al. | 23/424.5 X |
| 4,976,005 | 12/1990 | Graye | 15/322 |

*Primary Examiner*—Chris K. Moore

[57] ABSTRACT

The present invention relates to an improved cleaning solution applicator for use in a hot water carpet extractor. The applicator comprises an elongate, multi orifice, liquid distributor positioned within the discharge opening of an air distributing nozzle. Warm moist exhaust air discharged from the extractor's suction fan is directed through the air nozzle passing over top of and underneath the liquid distributor converging down stream of the liquid distributor and before exiting the air nozzle's exit opening. Liquid exiting the liquid distributor's orifices is thereby atomized and conveyed, by the flow of air from the air distributing nozzle, toward the surface being cleaned.

26 Claims, 18 Drawing Sheets

435
420
40
372
368
312
55
375
374
510
820
30
50
810
314
526
322
320
313
315
572
740
212
730
316
210
310R
326
310L
738
222
328
70
612
640L
608
23
638
23
672
680
624
710
65
60
616

420
422
435
434
480
418
436
438
470
482
426
464
479
475
476
478
462
485
477
460
484
416
410
402
413
454
452
450
442
448
444
415
446
412

CLEANING SOLUTION APPLICATOR

CROSS REFERENCE TO RELATED APPLICATIONS

This application is a continuation of U.S. patent application Ser. No. 08/183,287, filed Jan. 14, 1994, now U.S. Pat. No. 5,548,866, issued Aug. 27, 1996 and entitled "Cleaning Solution Applicator."

BACKGROUND OF THE INVENTION

The present invention relates to a hot water carpet extraction cleaner and more specifically to an improved cleaning solution applicator for applying liquid cleaning solution to the carpet being cleaned.

Heretofore many carpet extractors have typically employed "spray jets" to apply cleaning solution to the carpet surface. Typical examples of such techniques are taught in U.S. Pat. No. 4,956,891 issued to Richard F. Wulff on Sep. 18, 1990; U.S. Pat. No. 4,984,323 issued to Robert C. Berfield on Jan. 15, 1991; and U.S. Pat. No. 5,001,806 issued to Bernard Gustein on Mar. 26, 1991. Spray jets, of the type identified above, tend to place relatively large droplets of liquid upon the carpet as opposed to a more desirable atomized mist.

U.S. Pat. No. 4,712,740 issued to L. Scot Duncan et. al. on Dec. 15, 1987 titled "Venturi Spray Nozzle For A Cleaning Device," teaches a spray nozzle wherein streams of cleaning solution are injected into an air stream as the air flows through a venturi type passage way. Although some atomization of the cleaning solution may occur with this device, the nozzle is complex and comprises many individual parts, that are labor intensive to assemble and which are critical with respect to the spacial relationship of one part to another.

SUMMARY OF THE INVENTION

The present invention overcomes the above disadvantages, of the prior art, by providing a cleaning solution distribution nozzle which has few parts, is easy to assemble and effectively produces the desired atomization of the cleaning solution.

The herein disclosed cleaning solution applicator generally comprises an air distribution nozzle having a narrow, elongated exit slot fluidly communicating with the exhaust port of the extractor's suction fan. The high velocity air exiting the air distribution nozzle is generally directed toward the surface to be cleaned. The exit slot is preceded by a plenum chamber having positioned therein a fluid distributor for injecting a cleaning solution mixture into the air flowing from the exit slot. The fluid distributor preferably comprises two truncated triangular shaped, injection molded planer halves, one of which has embedded within the inside surface thereof, a multiple array of open top grooves or channels emanating from an embedded open top liquid manifold. Upon welding or cementing the two halves together a fluid distributor is formed having an internal manifold with an array of internal fluid flow channels emanating from the manifold and terminating at the extended lateral edge of the distributor as fluid exit orifices.

The fluid distributor, as a sub assembly, is positioned within the air distribution nozzle with the lateral edge thereof, having the flow channel orifices, positioned within the air nozzle's elongated exit slot, such that exhaust air is diverted overtop of and underneath the fluid distributor. The two diverted air flows converge immediately down stream of the fluid distributor's lateral edge thereby atomizing the cleaning solution emitted from the fluid channel orifices. Flow dams projecting outward from the distributor's lateral edge are provided between the fluid exit orifices to prevent lateral flow of cleaning solution along the distributor's lateral edge.

DETAILED DESCRIPTION OF THE INVENTION

Figure 1:
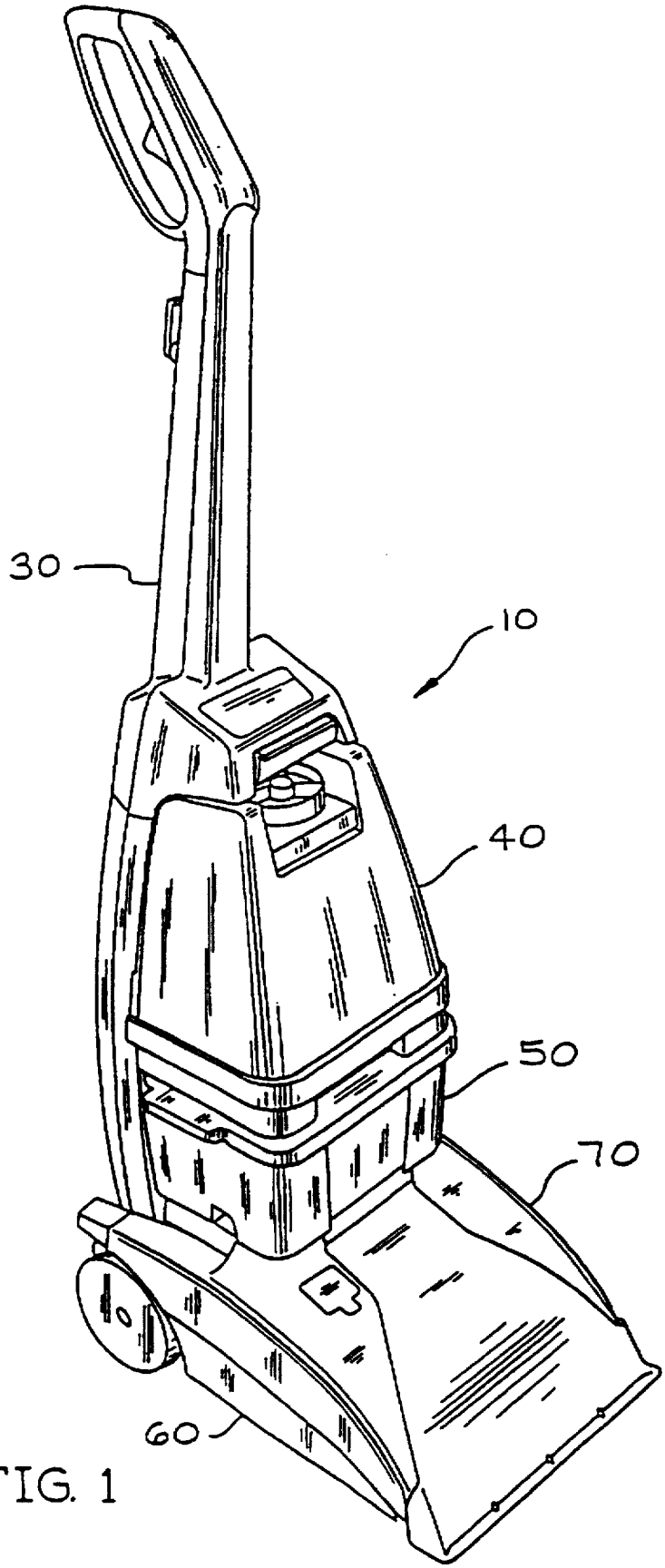
FIG. 1 presents a pictorial view of an upright carpet extractor embodying the present invention.
Figure 2:
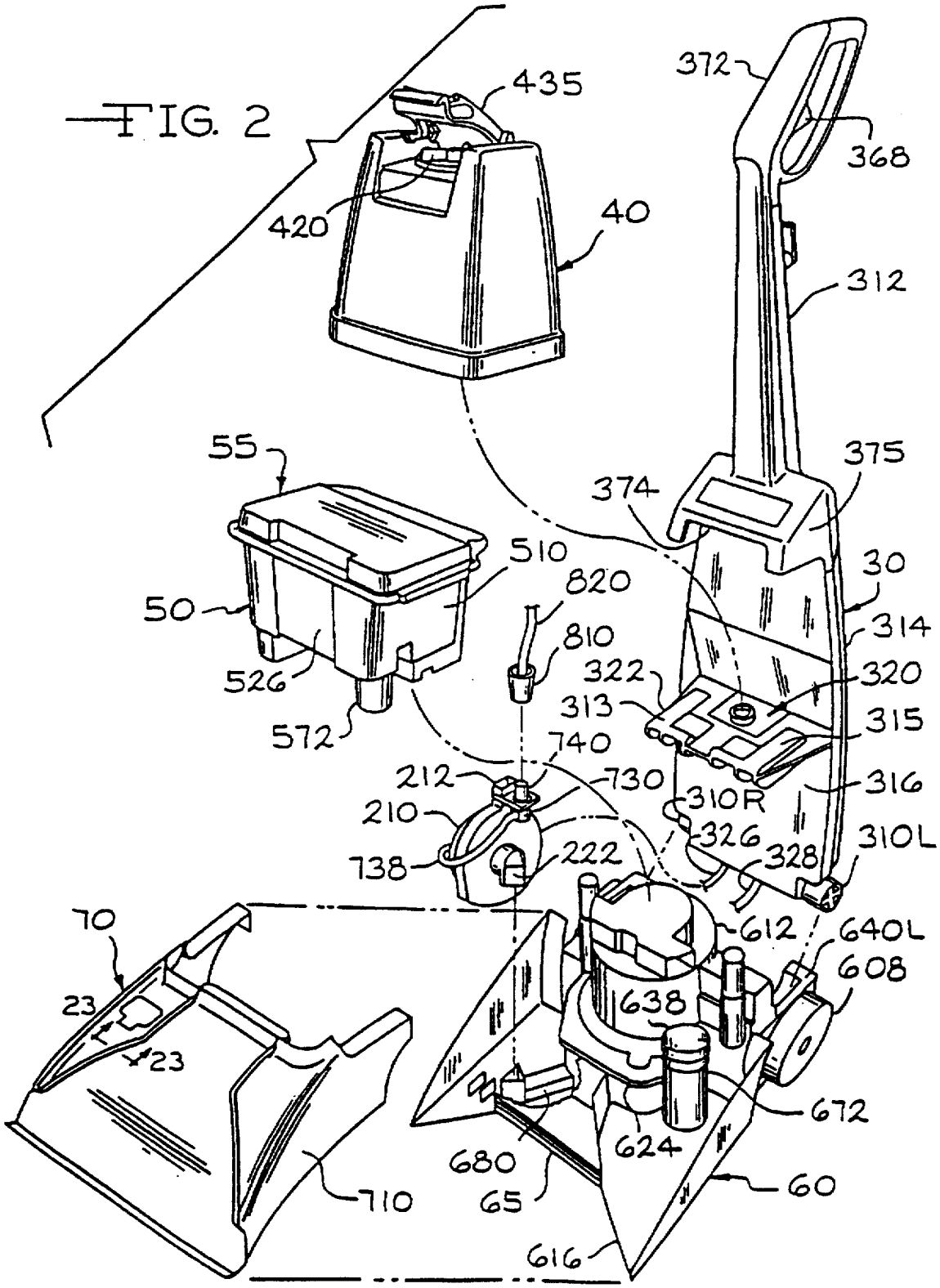
FIG. 2 presents an exploded view of a carpet extractor embodying the present invention illustrating the principal elements thereof.

FIGS. 1 and 2 a present pictorial and exploded view of an upright carpet extractor 10 embodying the present invention and illustrating the principal components and sub-assemblies thereof. Extractor 10 comprises a base frame assembly 60 upon which all other components or sub-assemblies are carried as best illustrated in FIG. 2. Specific details of base frame assembly 60 is further shown and illustrated in FIGS. 6 and 8B. Pivotally attached to base frame assembly 60 is handle assembly 30. Specific details of handle assembly 30 are further shown and illustrated in FIGS. 3, 8A, and 8B.

Removably supported upon handle assembly 30 is cleaning solution supply tank 40. Specific details of supply tank 40 are further shown and illustrated in FIGS. 4, 8A, and 8B.

Figure 8B:
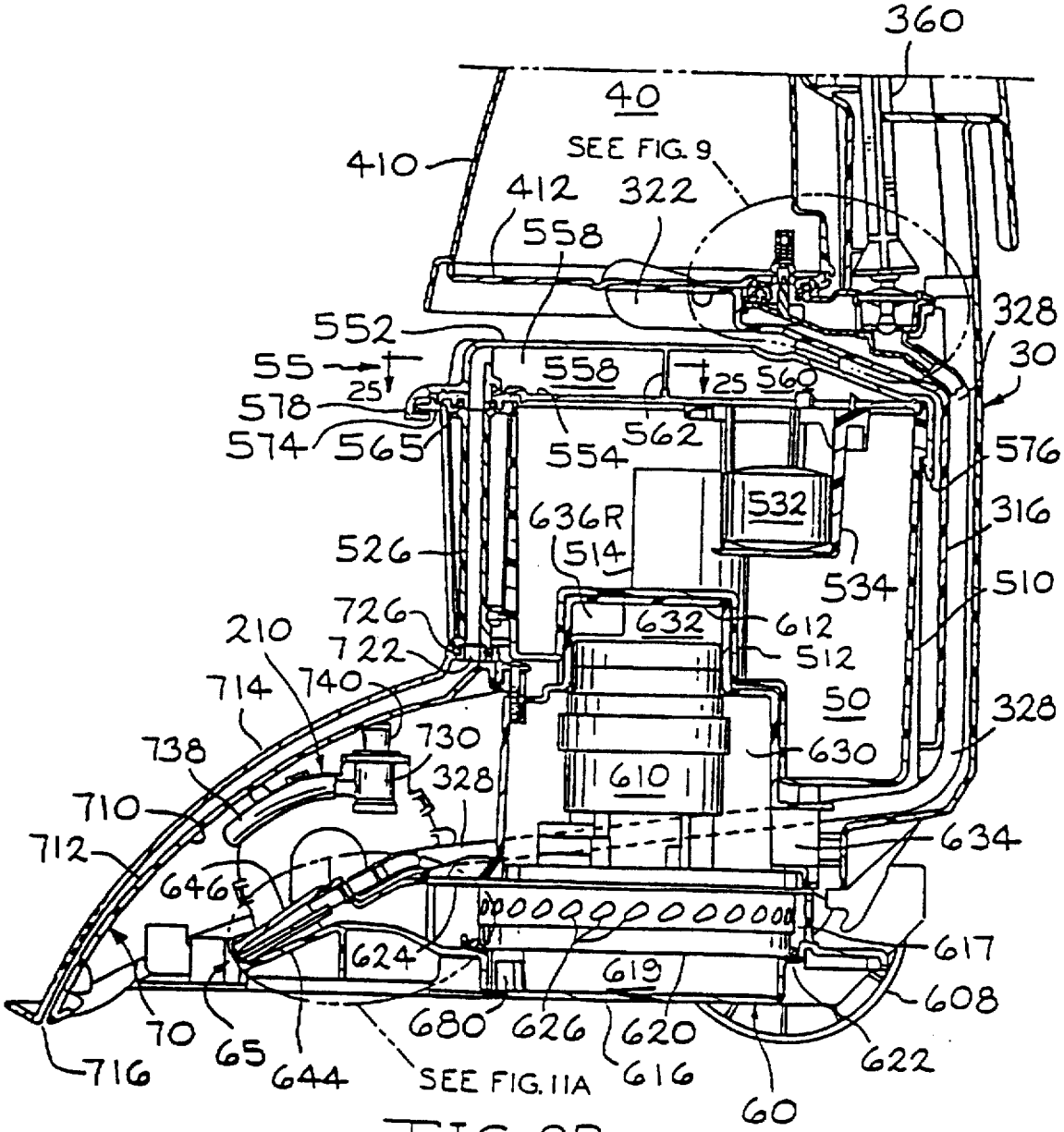

Removably setting atop base frame assembly 60 is a combined air/water separator and recovery tank 50. Specific details of the combination recovery tank 50 are further shown and illustrated in FIGS. 5 and 8B. Recovery tank 50 is configured to include a generally concave bottom 512 whereby tank 50 sets down over and surrounds a portion of the motor cover 612 of base frame assembly 60, as is best illustrated in FIG. 8B. It is preferred that recovery tank 50 set atop and surround a portion of the motor fan 610 thereby providing sound insulating properties and assisting in noise reduction of the extractor.

Fixedly attached to the forward portion of base frame assembly 60 is hood assembly 70 incorporating therein a floor suction nozzle. Specific details of hood assembly 70 are further shown and illustrated in FIGS. 7 and 8B.

Figure 6:
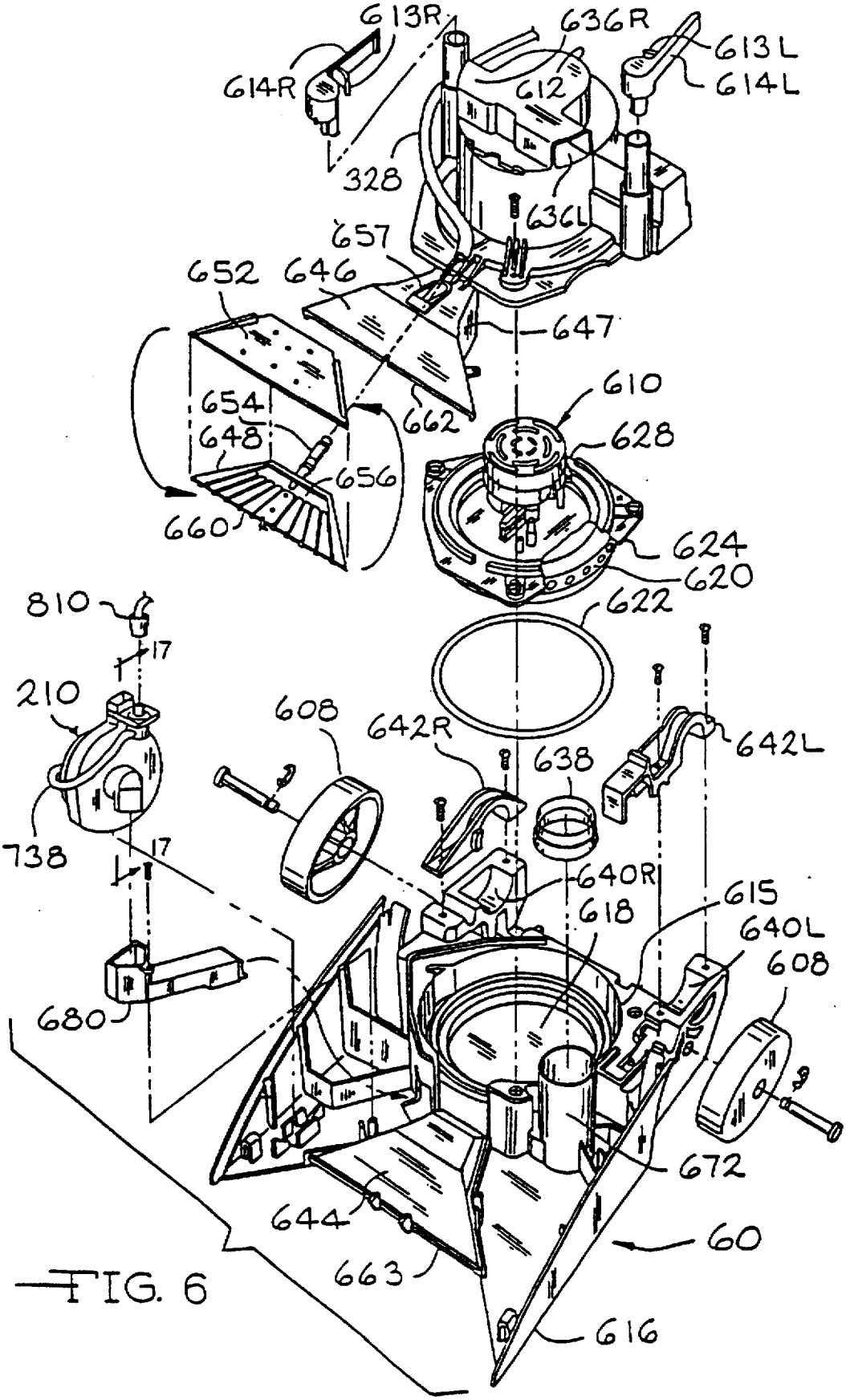
FIG. 6 presents an exploded pictorial of the upright extractor's base frame illustrating the principal elements thereof.

Referring now to FIGS. 2, 6 and 8B. The base frame assembly 60 generally includes a unitary molded base frame 616 having two laterally displaced wheels 608 suitably attached to the rear of the frame. Integrally molded into the bottom of frame 616 is a circular stepped basin 618 receiving therein the suction fan portion 620 of motor/fan assembly 610. The fan housing 620 of motor/fan assembly 610 rests upon the edge of stepped basin 618 having a sealing O-ring 622 therebetween thereby forming an inlet air plenum 619 about the fan eye. Mounting flange 624 of motor/fan assembly 610 similarly cooperates with ledge 615 of base frame 616 to form an exhaust air collecting ring 617 circumscribing the air exit ports 626 of the fan housing 620. Although prototype models have performed satisfactorily without a seal or gasket between flange 624 and ledge 615, it may be advantageous to place a seal or gasket therebetween to assure a leak-free juncture.

Motor cover 612 surrounds the motor portion 628 of motor/fan assembly 610 thereby defining a motor cooling air chamber 630 and a motor cooling exhaust manifold 632. Motor cooling air enters chamber 630 through a suitable inlet 634 and is exhausted through a fan (not shown) atop the motor into exhaust manifold 632 thereafter exiting through exhaust air outlet conduits 636L and 636R.

Integrally molded into base frame 616 is lower stand pipe 672 which sealing engages exit stand pipe 572 of recovery tank 510 via cylindrical seal 638 when tank 510 is placed atop motor cover 612 as best illustrated in FIG. 8B. Lower stand pipe 672 fluidly communicates with fan inlet plenum 619 thereby providing a vacuum source for recovery tank 510 as further described below.

Extending forward from motor cover 612 and integrally molded therewith is the top 646 and side walls 647 (the left side wall only being visible in FIG. 6) of the motor/fan working air discharge nozzle 65. Top 646 and side walls 647 join with bottom wall 644 (integrally molded into base frame 616) to form discharge nozzle 65 when motor cover 612 is placed atop motor/fan assembly 610.

Figure 5:
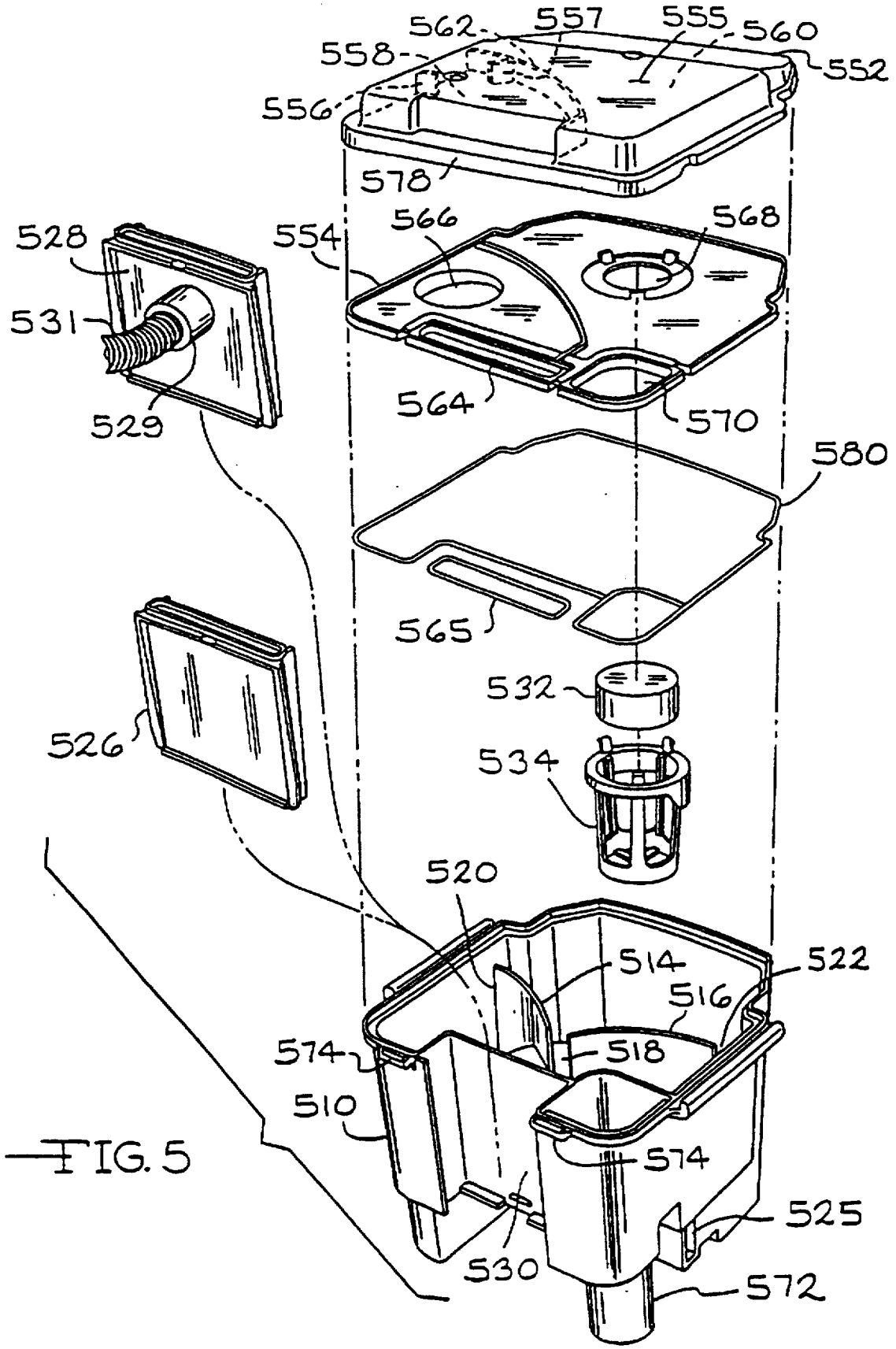
FIG. 5 presents an exploded pictorial of the air/fluid separator and liquid recovery tank illustrating the principal elements thereof.

Referring now to FIGS. 2, 5, and 8B. Recovery tank assembly 50 generally comprises an open top tank 510 wherein the bottom thereof 512 is configured to set atop and surround the top portion of motor cover 612 as best illustrated in FIG. 8B. Positioned inside tank 510 are two vertical baffles 514 and 516 which act to limit the degree of fluid sloshing during the forward and reverse push-pull operation of the extractor in the floor cleaning mode and assists in separation of liquid from the working air as described further below.

In addition to their function as anti-slosh baffles, baffles 514 and 516 also serve to prevent the establishment of a "short circuited" working airflow from exit opening 566 of inlet chamber 558 directly to inlet opening 568 of exit chamber 560. Baffles 514 and 516 act to disburse the incoming working air over that portion of the recovery tank's volume upstream of baffles 514 and 516 by forcing the working air to pass through openings 518, 520 and 522. Thus the velocity of the air as it passes through tank 510 is slowed to a minimum value and the time that the working air spends within tank 510 is at a maximum thereby providing for more complete liquid precipitation.

Baffles 514 and 516 are affixed to floor 512 extending upward therefrom as illustrated in FIGS. 5 and 8B. It is preferred that baffles 514 and 516 are free standing having open space 518 therebetween and open space 520 and 522 between the tank side wall and baffle 514 and 516 respectively to permit the free flow of recovered fluid therepast. Tank 510 is releasably affixed to motor cover 612 by two rotatable latches 614L and 614R (FIG. 6) having curved tangs 613L and 613R slidingly received within slot 525, in the left and right side walls of tank 510. Slidingly received within offset 530 in the forward wall of tank 510 is module 526 for the floor cleaning mode or conversion module 528 for the upholstery cleaning mode.

The recovery tank lid assembly 55 incorporates therein an air/fluid separator comprising a hollowed lid 552 and bottom plate 554 sealingly welded together forming a plenum therebetween. The plenum is divided into two separate and distinct chambers, an inlet chamber 558 and exit chamber 560, by separator wall 562 integrally molded into lid 552 and extending between lid 552 and bottom plate 554. Inlet chamber 558 fluidly communicates with floor cleaning module 526 or the upholstery/stair module 528 through inlet opening 564 in bottom plate 554. Any suitable sealing means 565 may be used between the module 526 or 528 and inlet opening 564 such as rope seal 565. Rope seal 565, and all other rope seals identified herein are preferably made from closed cell extruded cellular rubber. An inlet chamber exit passageway 566 in bottom plate 554 provides fluid communication between tank 510 and inlet chamber 558. Similarly exit chamber 560 includes entrance passage 568, in bottom plate 554 providing fluid communication between tank 510 and exit chamber 560. It is preferable to provide a float 532 within a suitable float cage 534 to choke the flow of working air through passage 568 when the reclaimed fluid within recovery tank 510 reaches a desired level. Exit chamber 560 further includes discharge opening 570 for fluid communication with an integrally molded stand pipe 572 of tank 510 when lid assembly 55 is attached to the open top of tank 510.

Integrally molded into lid 552 so as to be positioned about the periphery of exit opening 566 in bottom plate 554 are two vortex impeding baffles 556 and 557. Baffle 556 attached to both the side wall 553 and top wall 555 extends outward over exit opening 566 on a radial line thereof and perpendicular to side wall 553. Baffle 557 attached to both the top wall 555 and separator wall 562 of lid 552 extends from separator wall 562 to the immediate edge of opening 566 positioned at an angle to separator wall 562 such that the extended plane of baffle 557 intersects side wall 553 at the intersection of baffle 556 and side wall 553 and at an angle of approximately 45° with respect to side wall 553.

Lid assembly 55 is removably attached to tank 510 by the engagement of tangs 574, in the forward rim 578 of lid 552 and a cantilevered latching tang 576 at the rear of tank 510. Any suitable sealing means such as rope seal 580 may be used to seal the air/water separator assembly 55 from the recovery tank 510.

Figure 7:
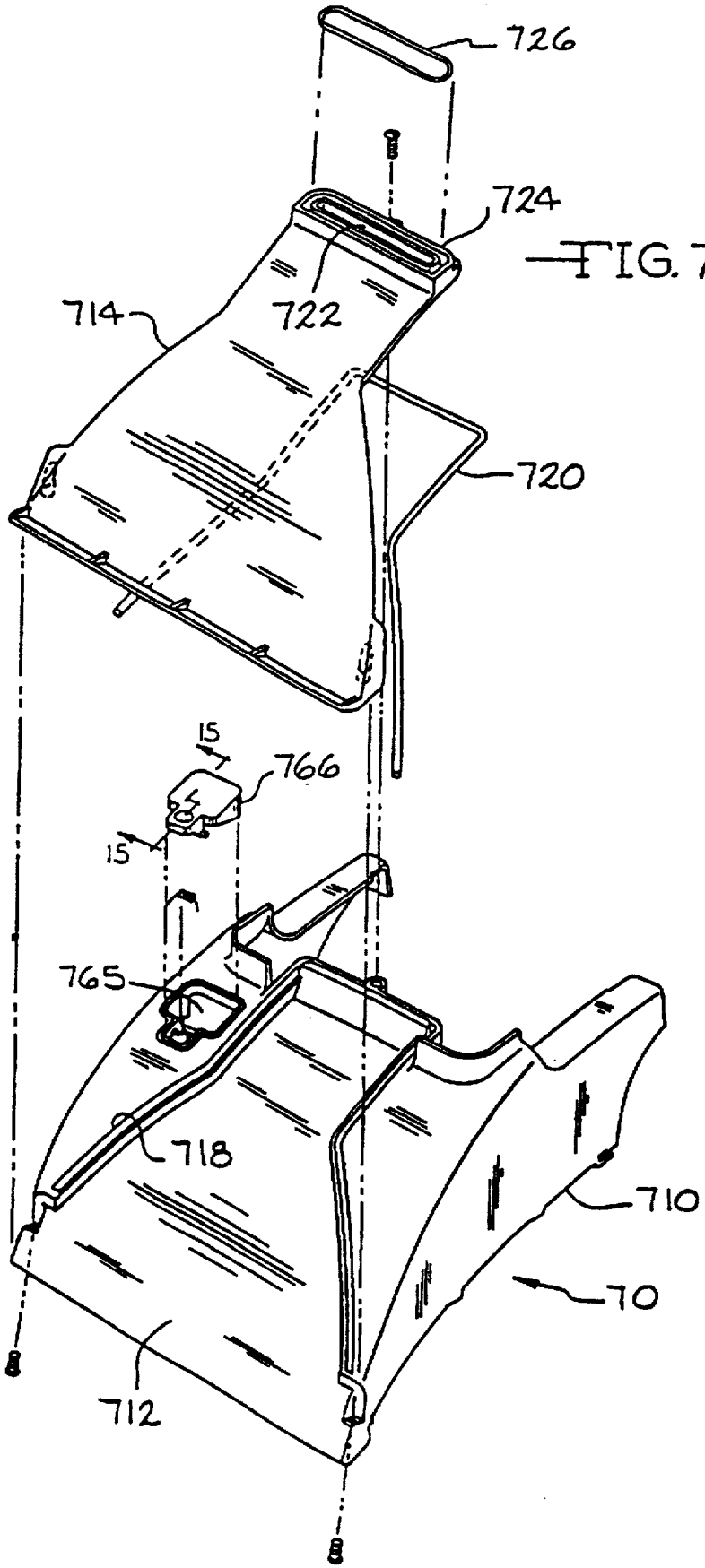
FIG. 7 presents an exploded pictorial of the upright extractor's combined suction nozzle and hood illustrating the principal elements thereof.

Referring now to FIGS. 2, 7, 8B, and 23, nozzle assembly 70 encloses the front portion of base frame 616 generally comprising a front hood 710 which is affixed to base frame 616. The forward portion of hood 710 incorporates therein a depressed zone 712 which, in cooperation with nozzle cover 714, forms a suction nozzle having an elongated inlet slot 716 laterally extending the full width of hood 710. Extending around the perimeter of depressed zone 712 is groove 718 which receives therein rope seal 720 and peripheral flange 719 of cover 714 thereby limiting all air entry, into the composite suction nozzle, to slot 716. Cover 714 further incorporates therein an integrally molded elongate discharge opening 722 circumscribed by groove 724 having rope seal 726 therein for sealingly engaging module 526 whereby the suction nozzle fluidly communicates with module 526. Cover 714 is preferably affixed to hood 710 by three screws as illustrated in FIG. 7.

When it is desired to convert to the upholstery and/or stair cleaning mode, floor module 526 is slidingly removed from slot 530 in the front wall of tank 510 and replaced with upholstery module 528. With upholstery module 528 in place all working air enters through hose inlet 529 thereby by passing the floor suction nozzle. Conversion from floor to above floor cleaning is discussed further below.

Referring now to FIGS. 2, 3, 6, 8A, and 8B, base frame 616, at the rear thereof, has integrally molded journals 640L and 640R for rotatingly receiving therein trunnions 310L and 310R of handle assembly 30. Trunnions 310L and 310R are rotatingly retained in place by trunnion retainers 642L and 642R, respectively.

Figure 3:
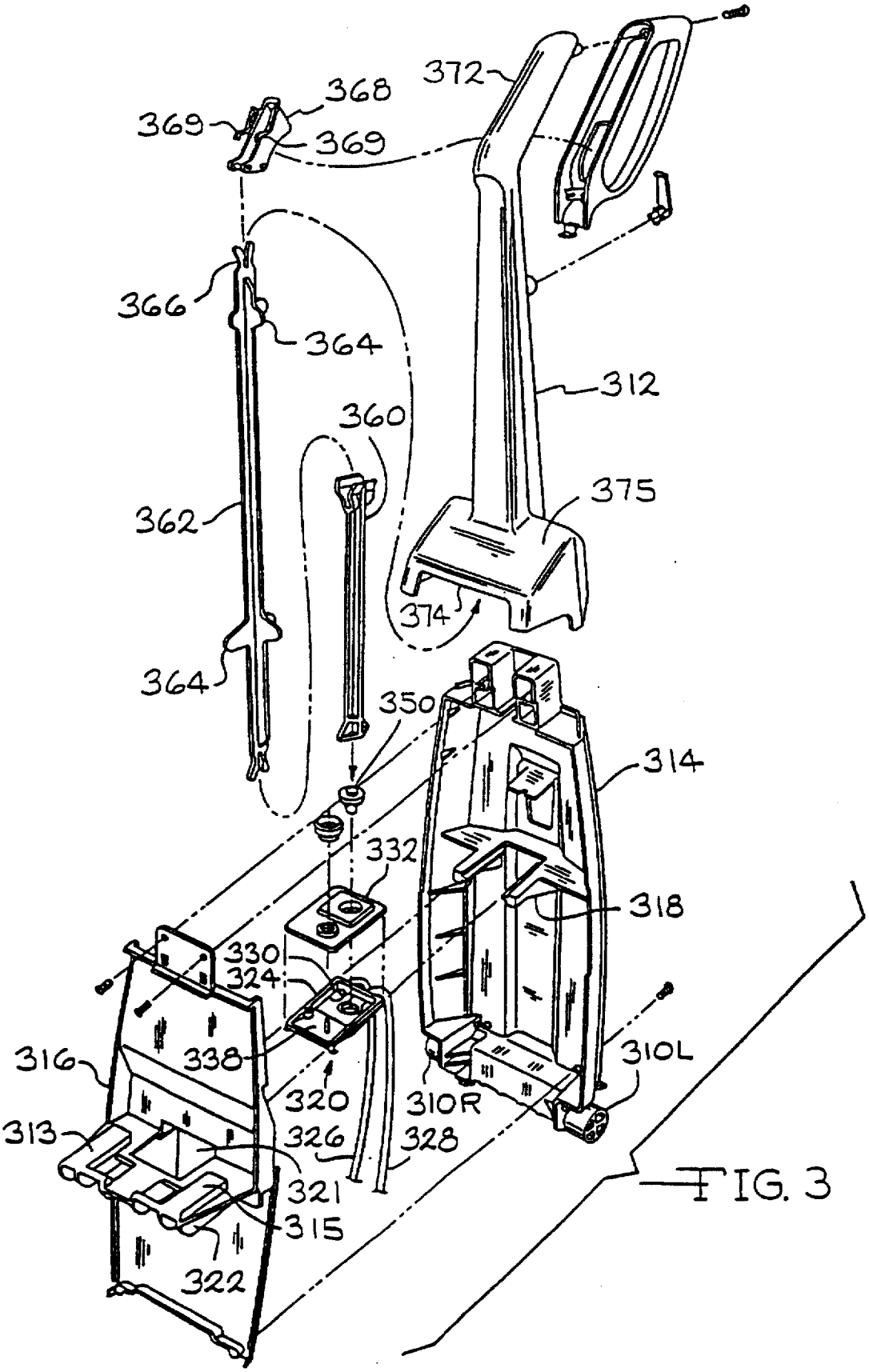
FIG. 3 presents an exploded view of the handle portion of the upright extractor illustrating the principal elements thereof.

Handle assembly 30 basically comprises an upper handle portion 312, lower body shell 314 and body shell face plate 316. The lower body shell 314 has integrally molded therein a cleaning solution reservoir support shelf 318 that has attached thereto, as generally illustrated in FIG. 3, a cleaning solution reservoir assembly 320. Reservoir 320 receives and holds a quantity of cleaning solution from supply tank 40 for distribution to supply tubes 326 and 328 as further described below. Upon assembly of face plate 316 to the lower body shell 314, the forward half of reservoir 320 protrudes through aperture 321, of face plate 316 aligning with the top surface of support shelf 322, as best seen in FIG. 2, such that the top surface of reservoir is generally planer with the top surface of shelf 322. The handle assembly 30 is completed by fixedly attaching the upper handle 312 to the combined body shell 314 and face plate 316 by telescopingly sliding upper handle 312 downward over attachment posts 311 of lower body shell 314 and securing with two screws (not shown).

Figure 9:
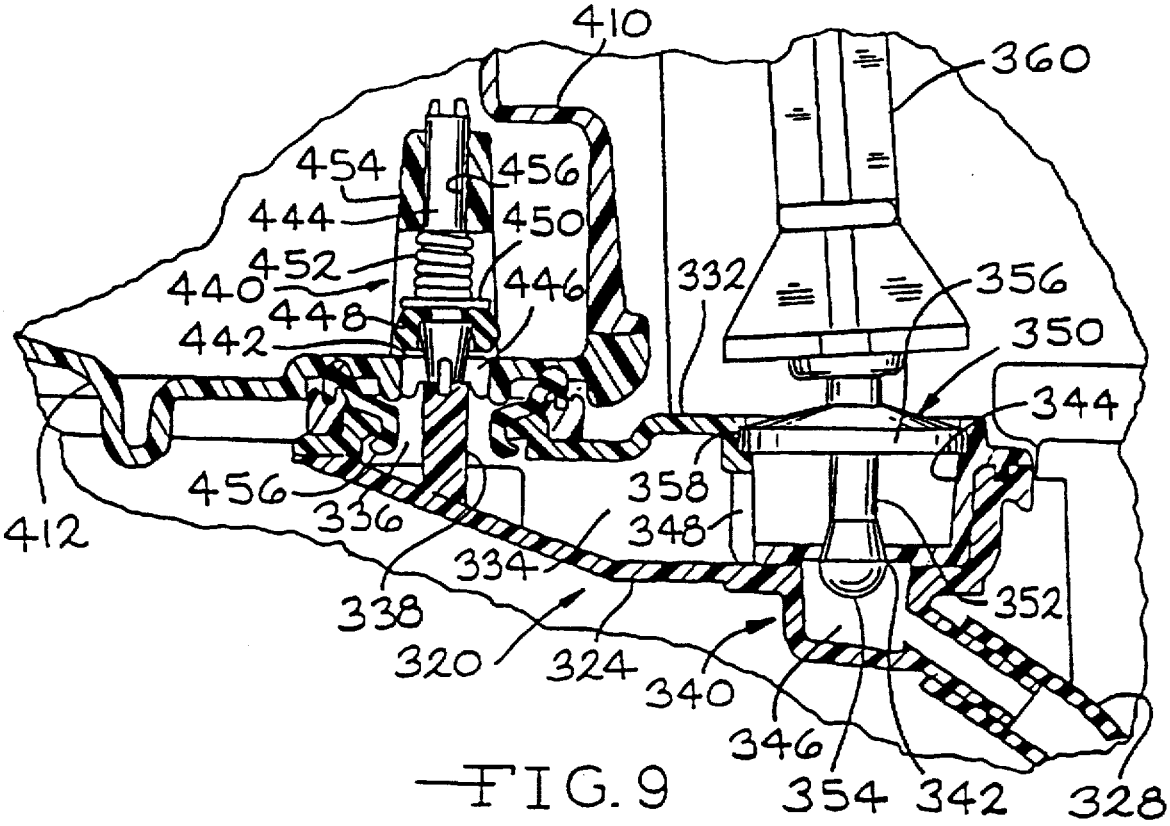
FIG. 9 is an enlarged cross-sectional view of the solution supply reservoir as identified in FIG. 8B.
Figure 15:
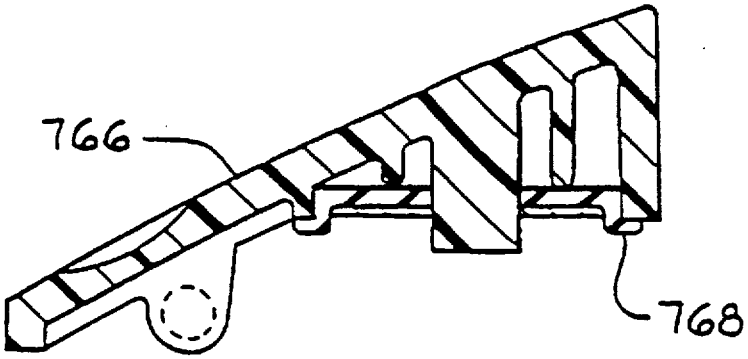
FIG. 15 is a sectional view of the air turbine inlet door taken along line 15—15 in FIG. 7.

Referring now to FIGS. 3, 8B, and 9. Cleaning solution reservoir 320 includes a bottom concave basin 324 having two supply tubes 326 and 328 exiting therefrom. Supply tube 326 provides a direct supply of cleaning solution, through discharge port 330, from reservoir 334 to auxiliary air turbine driven pump assembly 210 (FIG. 2), while supply tube 328 provides a valved release of cleaning solution from reservoir 334 to the cleaning solution distributor 65.

Cover plate 332 is sealingly attached to basin 324 thereby forming reservoir volume 334 which supply tank 40 floods with cleaning solution through inlet port 336. Extending axially upward through inlet port 336 is pin 338 which acts to open supply valve 440 of supply tank 40 as tank 40 is placed upon support shelf 322 and secured in place. The structure and operation of supply valve 440 is described further below.

Cleaning solution is released, upon operator demand, into tube 328 through solution release valve 340 which comprises valve seat 342 positioned in basic 324 of bowl 344 integrally formed with top cover 332. The basic 324 of bowl 344 extends across discharge port 346 such that valve seat 342 is aligned to open thereinto. An opening 348, within the wall of bowl 344, permits the free flow of cleaning solution from reservoir 334 into bowl 344. An elastomeric valve member 350 comprises an elongate piston 352 extending through valve seat 342 having a bulbous nose 354 at the distal end thereof within discharge port 346 as best illustrated in FIG. 9. Valve member 350 is preferably made from Monsanto "SANTOPRENE" 201-55 elastomeric material. The opposite end of piston 352 includes a downwardly sloped circular flange 356, the peripheral end of which frictionally and sealingly engages the upper circular rim 358 of bowl 344 thereby preventing leakage of cleaning solution thereby. Flange 356 acts to bias piston 352 upward thereby urging nose 354 into sealing engagement with valve seat 342 preventing the flow of cleaning solution from bowl 344 into discharge port 346 and tube 328.

The solution release valve 340 is operated by pressing downward upon the elastomeric release valve member 350 by push rod 360 thereby deflecting the center of flange 356 downward urging nose 354 downward and away from valve seat 342 permitting the passage of cleaning solution therethrough into discharge port 346 and tube 328. Energy stored within flange 356, as a result of being deflected downward will, upon release of the force applied to push rod 360, return the valve to its normally closed position as illustrated in FIG. 9.

Figures 8A, 10:
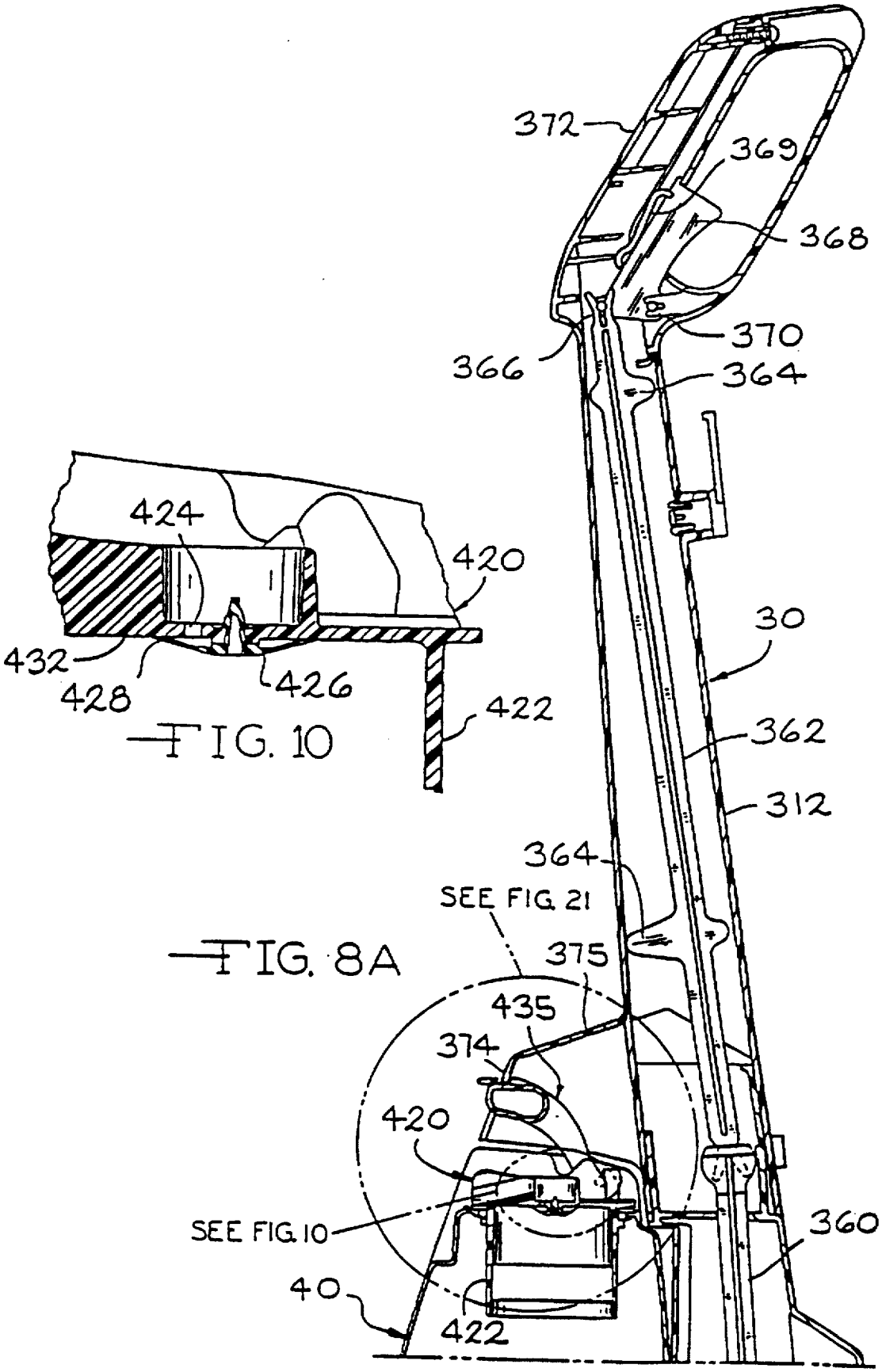
FIG. 8A and 8B present a side elevational cross-section taken vertically through the upright extractor illustrating the principal internal working elements.
FIG. 10 is an enlarged cross-sectional view of the atmospheric vent valve as indicated in FIG. 8A.

Referring now to FIGS. 3, 8A, 8B, and 9. Extending upward through handle assembly 30 is an articulated push rod comprising a lower rod 360 pivotly connected to upper rod 362. Push rods 360 and 362 are positioned within the handle assembly 30 by means of integrally molded spacers 364 dimensioned and located as necessary. The upper end 366 of push rod 362 is pivotally attached to trigger 368. Integrally molded onto trigger 368 are two cantilever springs 369, one on each lateral side thereof. Trigger 368 is pivotally attached to the handle at pivot 370; thus cantilever springs 369 urge trigger 368 and the attached articulated push rod 360, 362 towards the valve closed mode as illustrated in FIG. 8A. Cantilever springs 369 are engineered to support the combined weight of push rods 360 and 362 such that no force is applied to elastomeric valve member 350. Upon the operator squeezing the hand grip 372 and trigger 368, cantilever springs 369 yield thereby permitting counterclockwise rotation of trigger 368 about pivot 370 with a resulting downward movement of push rods 360 and 362 thereby opening solution release valve 340 causing gravitational flow of cleaning solution from reservoir 334 to tube 328. Upon release of trigger 368 energy stored in the system returns valve 340 to the closed mode.

The pivotal connections between push rods 360 and 362, between trigger 368 and push rod 362, and between trigger 368 and handle 312 generally comprise a pivot pin snappingly received within a detent formed between the legs of a two pronged snap as best seen in FIG. 8A at pivot 366 between push rod 362 and trigger 368.

Figure 4:
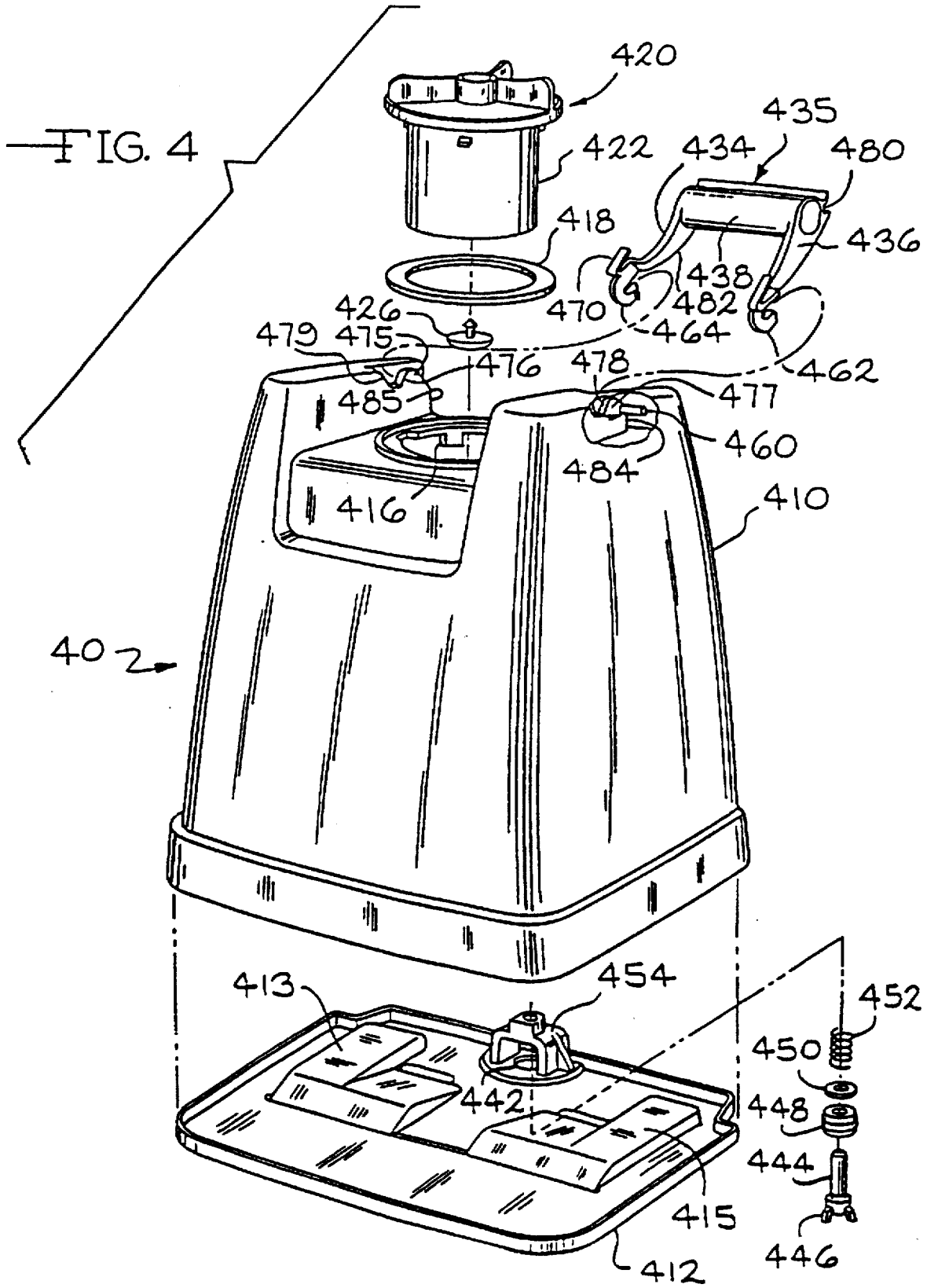
FIG. 4 presents an exploded pictorial of the solution supply tank illustrating the principal elements thereof.

Referring now to FIGS. 2, 3, 4, 8B and 9. Removably supported upon support shelf 322 of handle assembly 30 is cleaning solution supply tank 40. As illustrated in FIG. 4, supply tank 40 basically comprises a deeply hollowed upper body 410 and a relatively planer bottom plate 412 which is fusion welded, about its periphery, to the upper body 410. The bottom plate 412 is provided with suitable recessed areas 413 and 415 which index upon and receive therein corresponding raised portions 313 and 315 on support shelf 322, of handle assembly 30, when supply tank 40 is placed upon shelf 322.

Incorporated into bottom plate 412 of tank 40 is a solution release valve mechanism 440 comprising valve seat 442 having an elongate plunger 444 extending coaxially upward therethrough. Plunger 444 having an outside diameter less than the inside diameter of valve seat 442 is provided with at least three flutes 446 to maintain alignment of plunger 444 within valve seat 442 as plunger 444 axially translates therein and permits the passage of fluid therethrough when plunger 444 is in the open position.

An open frame housing 454 is located atop valve seat 442 having a vertically extending bore 456 slidingly receiving therein the upper shank portion of plunger 444. An elastomeric circumferential seal 448 circumscribes plunger 444 for sealingly engaging valve seat 442. Seal 448 is urged against valve seat 442 by action of compression spring 452, circumscribing plunger 444, and positioned between frame 454 and seal 448 preferably with a washer 450 therebetween. Solution release valve 440 is normally in the closed position. However, as supply tank 40 is placed upon support shelf 322 of handle 30, pin 338 of the cleaning solution supply reservoir 320 aligns with plunger 444 and is received within flutes 446, as best illustrated in FIG. 9, thereby forcing plunger 444, upward compressing spring 452, and opening valve seat 442 permitting cleaning solution to flow from tank 40 into reservoir 320. Upon removal of tank 40 from support shelf 322 the energy stored within compression spring 452 closes valve seat 442.

Referring now to FIGS. 4, 8A, and 10. Located at the top of tank 40 is fill opening 416 through which tank 40 may be conveniently filled with cleaning solution. To assure that the ambient pressure within tank 40 remains equal to atmospheric, as cleaning solution is drawn from tank 40, a check valve is provided in the top of cap 420 comprising a multiplicity of air breathing orifices 424 and an elastomeric umbrella valve 426. As the ambient pressure within tank 40 drops, by discharge of cleaning solution from therein, atmospheric pressure acting upon the top side of umbrella valve 426 causes the peripheral edge 428 to unseat from surface 432 of cap 420 thereby permitting the flow of atmospheric air into tank 40 until the ambient pressure therein equals atmospheric. Once the pressure on both sides of the umbrella valve equalize, the energy stored by deflection of the umbrella valve causes the peripheral edge 428 to reseat itself against surface 432 thereby preventing leakage of cleaning solution through orifices 424 during operation of the extractor.

Cap 420 and flat circular seal 418 sealingly close fill opening 416. Cap 420 incorporates an inverted cup portion 422 which serves as a convenient measuring cup for mixing an appropriate amount of concentrated cleaning solution with water in tank 40. When cap 420 is inverted and used as a measuring cup, liquid pressure against umbrella valve 426 further urges peripheral edge 428 against surface 432 thereby providing a leak free container.

Figure 21:
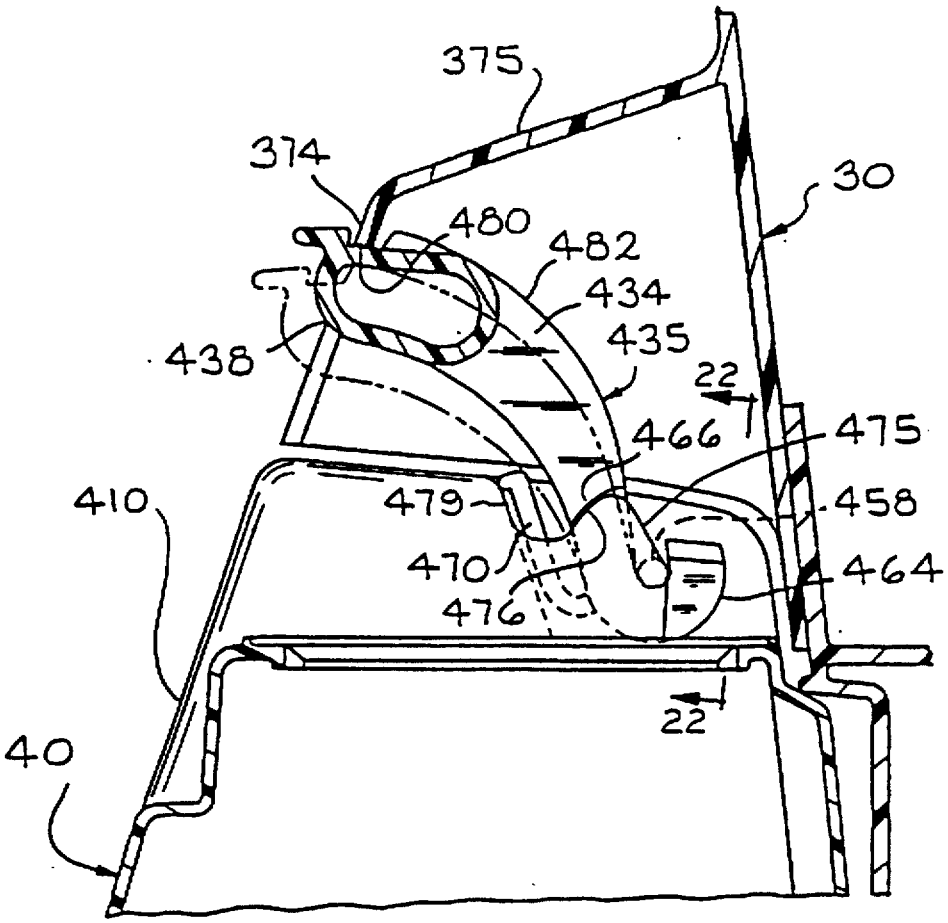
FIG. 21 is an enlarged cross-sectional view of the solution supply tank latching handle as identified in FIG. 8A.
Figure 22:
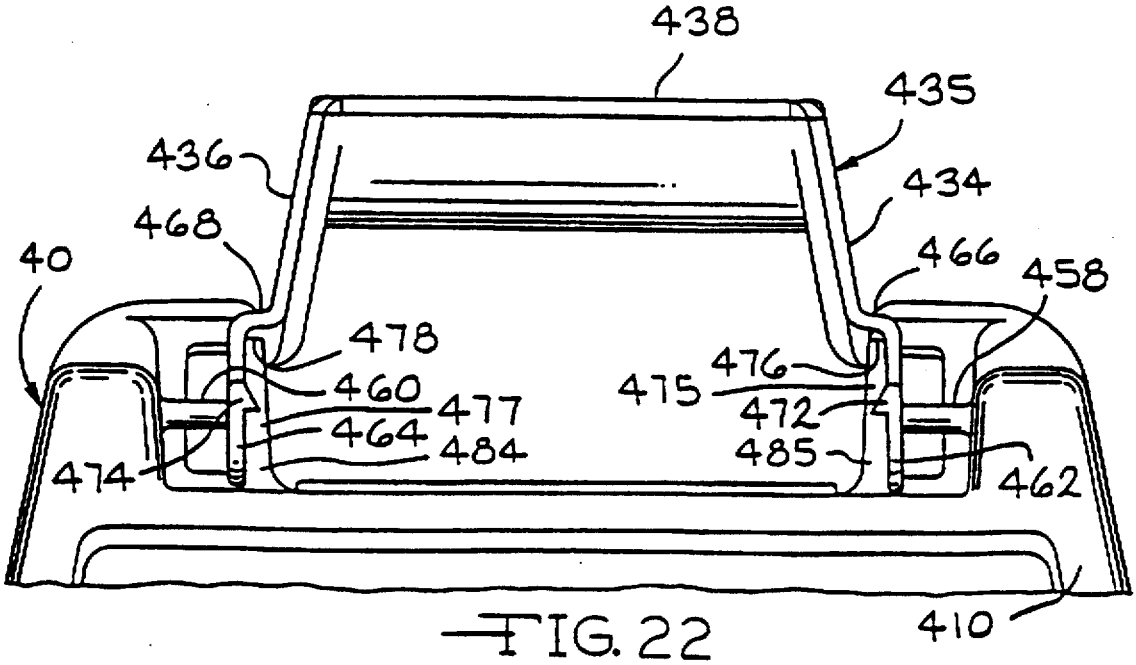
FIG. 22 is an elevational view taken along line 22—22 of FIG. 21.
Figure 23:
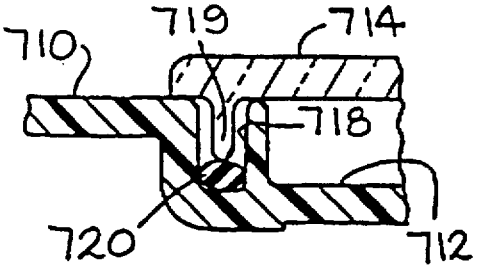
FIG. 23 is a cross-sectional view taken along line 23—23 of FIG. 2.

Referring now to FIGS. 2, 4, 8A, 21, and 22, the solution supply tank 40 includes a combination carrying handle and tank securement latch 435 providing a convenient means for carrying the tank and/or securing the tank to the extractor handle assembly 30. Tank handle 435 comprises a generally horizontal handle bar portion 438 having arcuate camming arms 434 and 436 integrally attached at each end thereof. The two camming arms 434 and 436 are generally parallel, as best seen in FIG. 22, each terminating with an approximately 180° bend 464 and 462 at the end thereof. "U" shaped bends 464 and 462 form journals for receiving therein and rotatably attaching to pins 460 and 458 of the supply tank upper body 410 thereby supporting supply tank 40 therefrom when carried by handle 435.

Each arm 434 and 436 includes a lateral offset 466 and 468 which cam upon surfaces 476 and 478, of rails 475 and 477 respectively, as handle 435 rotates counterclockwise about pins 458 and 460 as viewed in FIG. 21. Further, as handle 435 rotates counterclockwise, integrally molded cantilever spring 470 (one preferably associated with each arm 434 and 436) acting upon surface 479 bends, thereby storing energy therein biasing handle 435 clockwise.

When tank 40 is placed upon support shelf 322 of handle assembly 30 and rotated clockwise (as viewed in FIG. 21) into the installed position, camming surface 482 (provided upon each arm 434 and 436) engages and cams upon edge 374 of hood 375 forcing handle 435 downward until notch 480, on handle bar 438, entraps edge 374 therein thereby securing tank 40 in place. To release tank 40 the operator grasps handle bar 438 pulling it downward against the retarding force of cantilever springs 470, as illustrated in FIG. 21 by broken lines, thereby releasing notch 480 from locking engagement with edge 374 of hood 375 and removes tank 40 from support shelf 322 of extractor handle assembly 30. The camming action of offset 466 and 468 upon camming surfaces 478 and 476 act to maintain the 180° bends 462 and 464 in contact with pins 458 and 460, respectively and provide a retarding force, against rails 475 and 477, securing tank 40 in place so long as handle bar 438 latchingly engages hood 375. Laterally extending tangs 472 and 474 provide rotational stops which engage surfaces 484 and 485 thereby preventing over travel of handle 435 and inadvertent removal of the handle from pins 458 and 460.

Turning now to FIGS. 6, 8B, 11A, 11B, 12, 13, and 14. The suction fan discharge nozzle 65 is cooperatively formed by nozzle bottom plate 644 integrally molded into base frame 616 and top cover 646 integrally molded onto motor cover 612. Positioned within discharge nozzle 65 is the cleaning solution distributor 650 comprising an upper distribution plate 648 and a lower cover plate 652. Plates 648 and 652 are shown in an inverted position (rotated 180 degrees) in FIG. 6 to better illustrate the inside surface of distribution plate 648.

Figure 12:
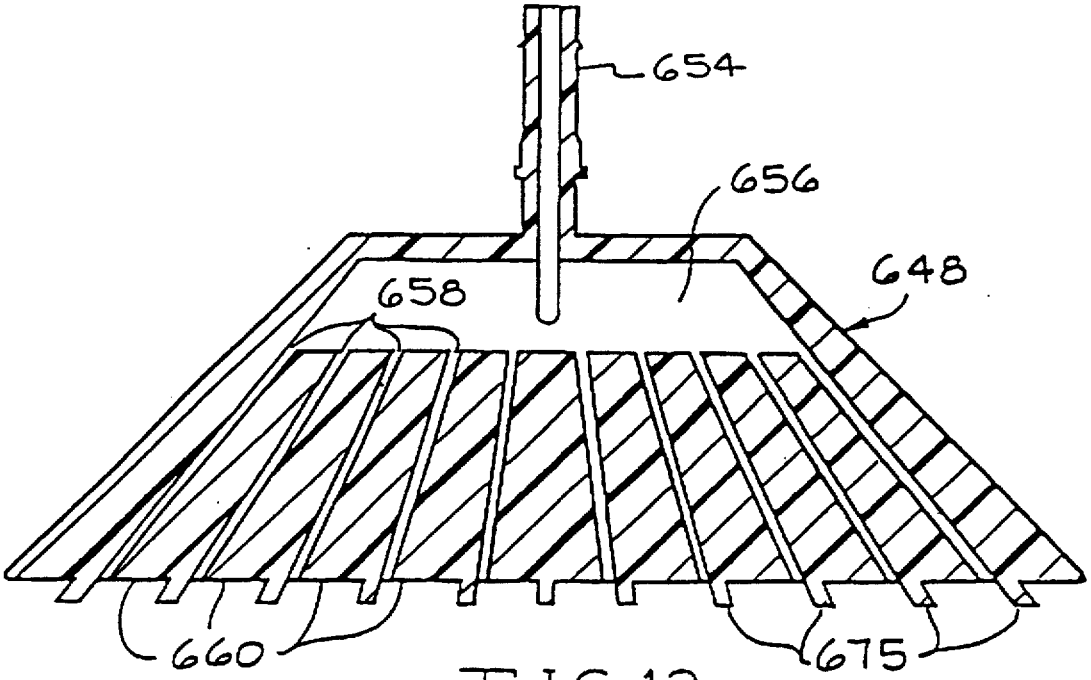
FIG. 12 is a sectional view taken along line 12—12 of FIG. 11.
Figure 13:
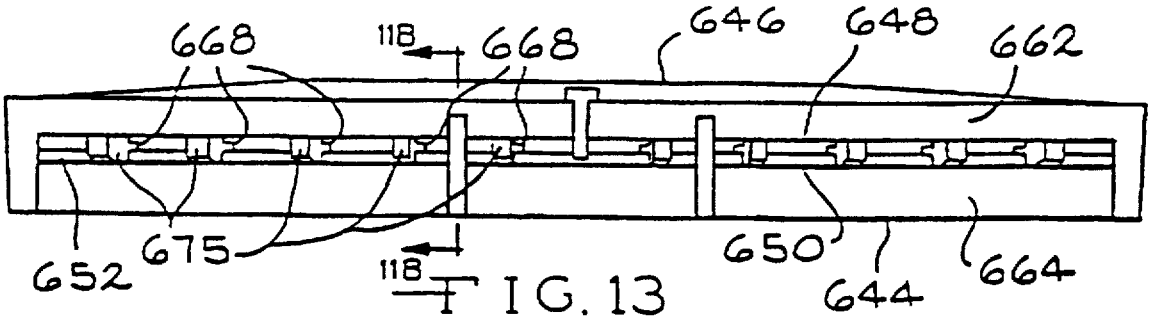
FIG. 13 is an elevational view taken along line 13—13 in FIG. 11 illustrating the exit end of the exhaust air distribution nozzle.
Figure 14:
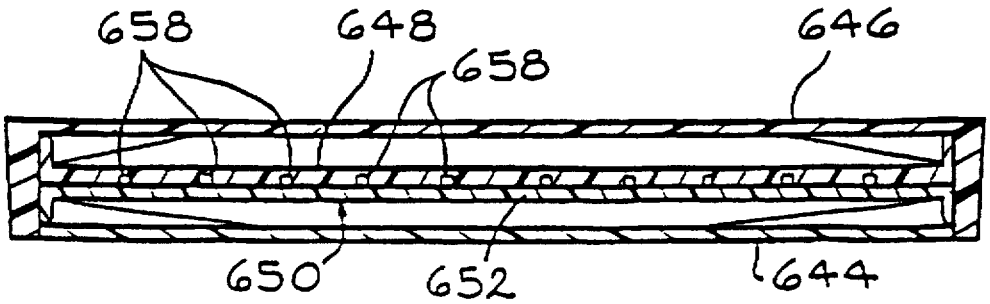
FIG. 14 is a sectional view taken along line 14—14 in FIG. 11.
Figure 16:
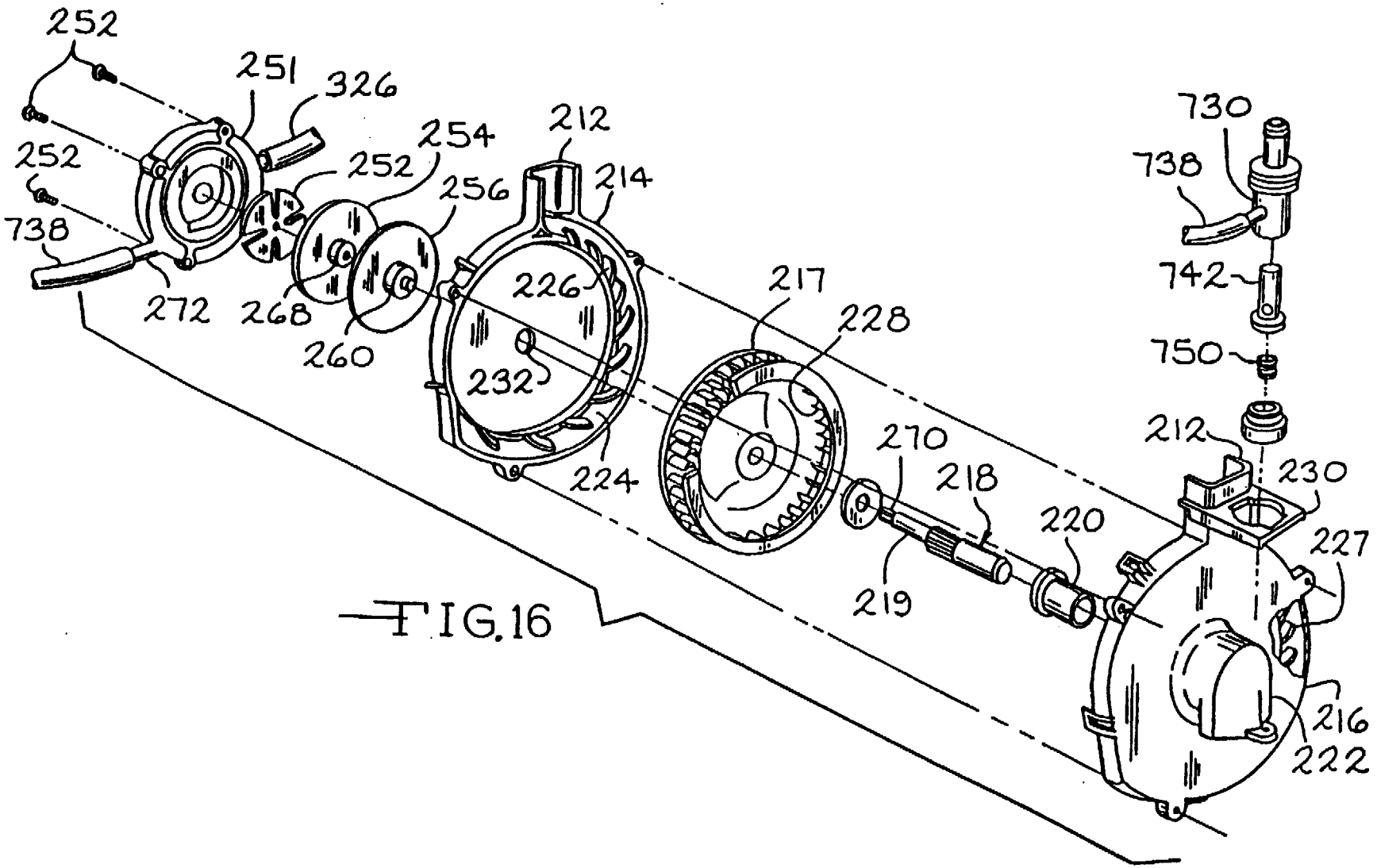
FIG. 16 is an exploded pictorial illustrating the elements comprising the air turbine solution pump assembly.

The upper distribution plate 648 includes, molded integral therewith, cleaning solution inlet tube 654 which projects through opening 657 of top cover 646 and fluidly connects to the distributor supply hose 328. Recessed within top cover 648 is a liquid supply manifold 656 fluidly communicating with supply hose 328 via inlet tube 654. Also recessed within the inner surface of top cover 648 and fluidly communicating with manifold 656 are a multiplicity of fluid conveying ducts 658 emanating from manifold 656, as best illustrated in FIG. 12, and terminating at the lateral edge 660 of upper plate 648. Lower plate 652 generally comprises a flat plate that when welded to or otherwise sealingly attached to upper plate 648 cooperates therewith to complete manifold 656 and its emanating fluid ducts 658.

Figures 11A, 11B:
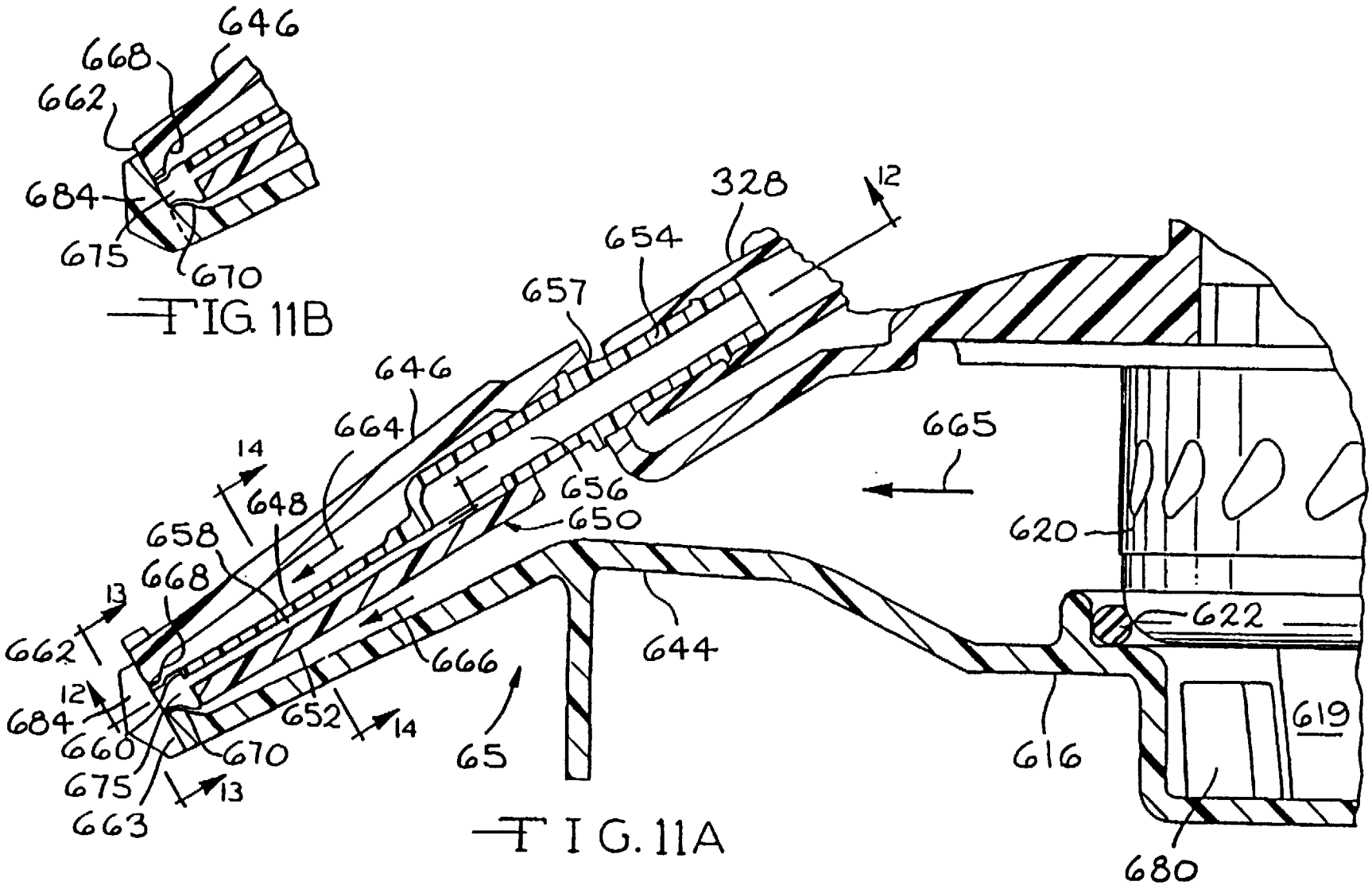
FIG. 11A is an enlarged cross-sectional view of the exhaust air distribution nozzle and cleaning solution distributor as indicated in FIG. 8B.
FIG. 11B is a partial cross-section view taken along line 11B—11B of FIG. 13.

As best illustrated in FIG. 11A, the cleaning solution distributor 650 is positioned within discharge nozzle 65, by any suitable means, such that lateral edge 660 is suspended equally between and upstream of upper lip 662 and lower lip 663 of nozzle 65 whereby exhaust air from fan 620, indicated by arrow 665, exiting through nozzle 65 is divided into two flows, an upper airflow, indicated by arrow 664 and flowing over top of fluid distributor 650, and lower airflow indicated by arrow 666 flowing below fluid distributor 650. As airstreams 664 and 666 approach the discharge nozzle lips 662 and 663, they are convergingly directed toward one another by sloped surfaces 668 and 670, respectively, thereby converging immediately downstream of the distributor's lateral edge 660. Liquid cleaning solution flows, by gravity, from supply tank 40 to manifold 656, via hose 328, through ducts 658 and into the turbulent airflow created by the converging airflows 664 and 666 exiting discharge nozzle 65.

Flow dams 675, integrally molded onto top plate 648 and extending downstream from the lateral edge 660 thereof may be used to assist in positioning distributor 650 within discharge nozzle 65 if desired. Flow dams 675 are preferably positioned adjacent the exit orifice of each flow duct 658, as illustrated in FIG. 12, thereby serving as dams to prevent liquid cleaning solution, exiting ducts 658, from adhering to and flowing laterally along the distributor lateral edge 660.

The turbulent airflow exiting exhaust nozzle 65 exhibited a tendency to create an audible whistling noise on certain prototype models. It was discovered that, by the addition of strakes 682 and 684, the objectionable whistle is significantly reduced or eliminated. Strakes 682 and 684 are preferably molded as an integral part of lower lip 663, as illustrated in FIG. 11B, extending upwardly adjacent upper lid 662 and remaining external to the nozzle exit slot.

Figure 17:
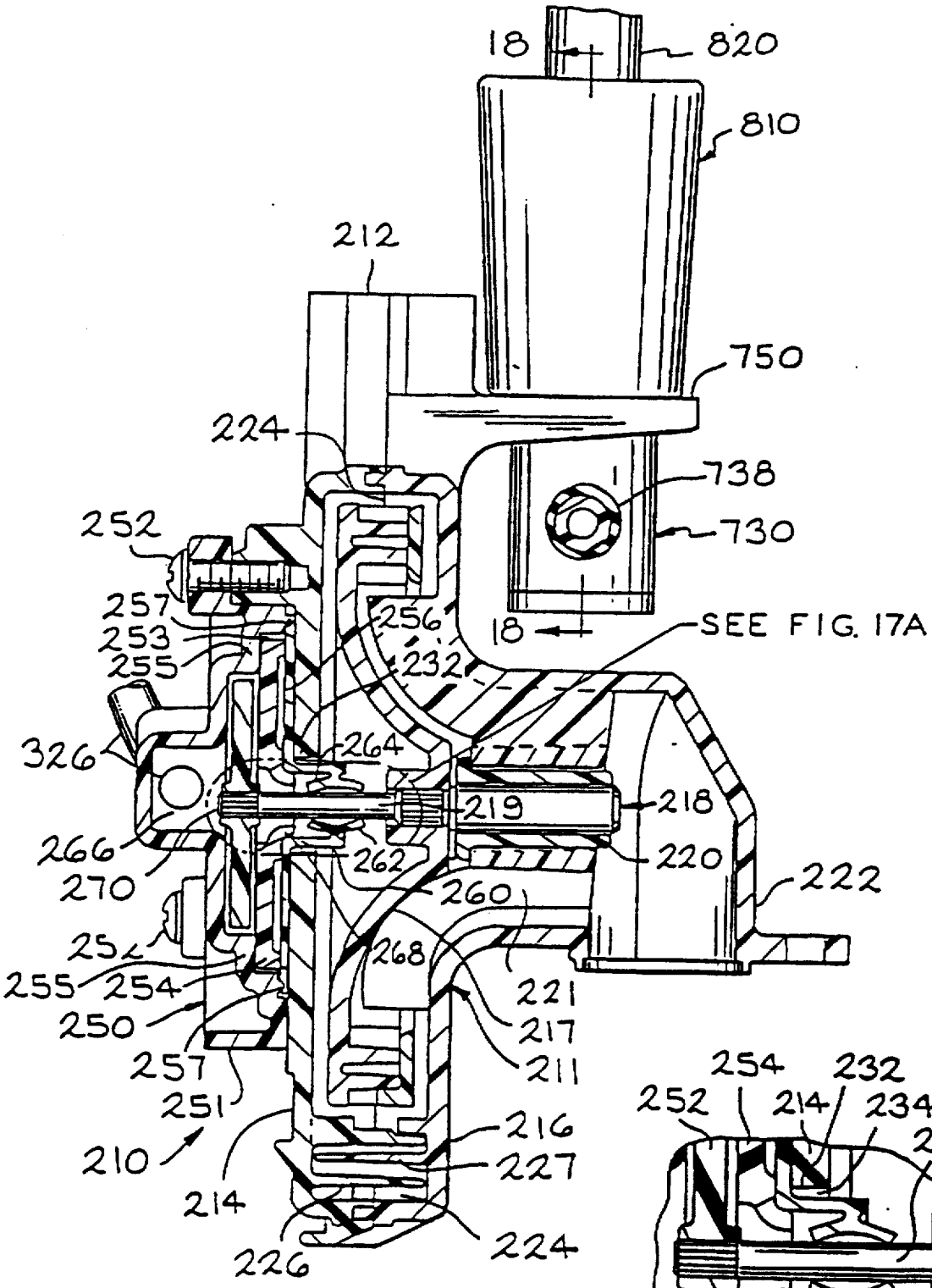
FIG. 17 is a cross-sectional view of the air turbine solution pump assembly taken along line 17—17 in FIG. 6.
Figure 17A:
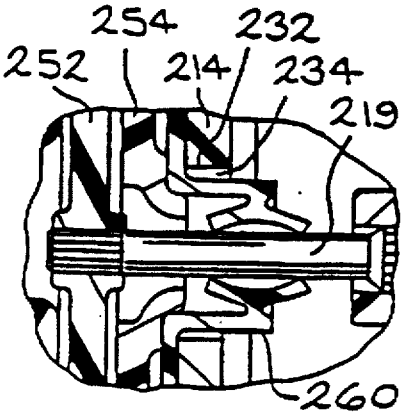
FIG. 17A is an enlarged cross-sectional view of the shaft seal as identified in FIG. 17.

Referring now to FIGS. 2, 6, 8B, 16 and 17. The air turbine driven cleaning solution supply pump assembly 210 comprises an air driven turbine portion 211 (elements 214 through 220 in FIG. 16) and a centrifugal liquid cleaning solution supply pump portion 250 (elements 251 through 256 in FIG. 16) attached thereto and sharing a common rotating shaft 218. The air turbine half 211, of the turbine pump assembly 210, typically comprises two mating half housings 214 and 216. Exit housing 216 has integral therewith a center line discharge passageway 221 exiting housing 216 as an elbow discharge port 222 which fluidly communicates with elbow duct 680 (FIGS. 2 and 6). Axially centered within discharge passage 221 is bearing 220 rotatingly receiving therein shaft 218 having affixed thereto air turbine 217. When assembled, housings 214 and 216 encapsulate turbine 217 therebetween and cooperate to form an arcuate air inlet plenum 224 about a portion of the turbine periphery. Positioned within and integrally molded into inlet plenum 224 is a series of flow directing stator vanes 226 for directing incoming air into the turbine buckets 228 of turbine 217. A similar set of integrally molded air directing vanes 227 is provided with exit housing 216. The integrally molded air directing vanes in both housings 214 and 216 are configured such that the vanes of each housing axially extend between the vanes of the other as illustrated in FIG. 17. Further when housings 214 and 216 are assembled they cooperate to form inlet port 212. Integrally molded onto exit housing 216 is bracket 230 for attaching thereto a solution discharge valve 730. A detailed description of discharge valve 730 is provided below.

When the turbine portion 211 is assembled, shaft 218 extends axially through opening 232 as best illustrated in FIG. 17. The cleaning solution centrifugal pump 250 comprises pump housing 251 affixed to the air turbine end housing 214 by fasteners 252 as illustrated in FIG. 17. A full disc, self centering, elastomeric seal 256 is compressed against turbine end housing 214 by bead 257 circumscribing pump housing 251 thereby forming a water tight seal therebetween. Seal 256, at the axial center thereof includes an axially offset cylindrical nose portion 260 which axially protrudes through opening 232 of turbine end housing 214. Extending radially inward from nose 260 are two axially spaced sealing blades 262 and 264 sealingly engaging the outer periphery of the stepped down portion 219 of shaft 218 thereby fluidly sealing chamber 266 from air turbine 211. Circular plate 254 is forced against seal 256 by rim 255 of pump housing 251 having at the axial center thereof a flanged opening 268 through which the impeller end 270 of shaft 218 extends receiving thereon slotted impeller disc 252. Flanged opening 268 of plate 254 assists in radially positioning plate 254 about shaft 219.

Seal 256 incorporates a self centering feature especially useful during assembly of the turbine pump assembly. During assembly the turbine portion, elements 214 through 220, are assembled first. Seal 256 is then placed on shaft portion 219 and axially positioned such that nose portion 260 extends through opening 232 of end housing 214. Opening 232 is larger in diameter than the outside diameter of nose portion 260 providing an annular gap 234 about nose portion 260. Thus seal 256, when placed upon shaft 218, radially positions itself within opening 232. Bearing plate 254 similarly aligns itself radially of placement of radial flange 268 inside nose portion 260 of seal 256 during assembly; annular gap 253 thereby provides radial movement of plate 254 about shaft 219.

In operation vacuum is applied to the air turbine discharge port 222 via elbow duct 680 and suction fan 620 thereby causing clean atmospheric air to enter turbine inlet port 212 passing through and thereby driving turbine 217. As turbine 217 rotates pump impeller 252 is also rotated via shaft 218 thereby drawing cleaning solution into pump chamber 266 via supply tube 326 from reservoir 320 and discharging the fluid from the pump discharge port 272, under pressure, to solution discharge valve 730 via cross over tube 738.

Figure 20:
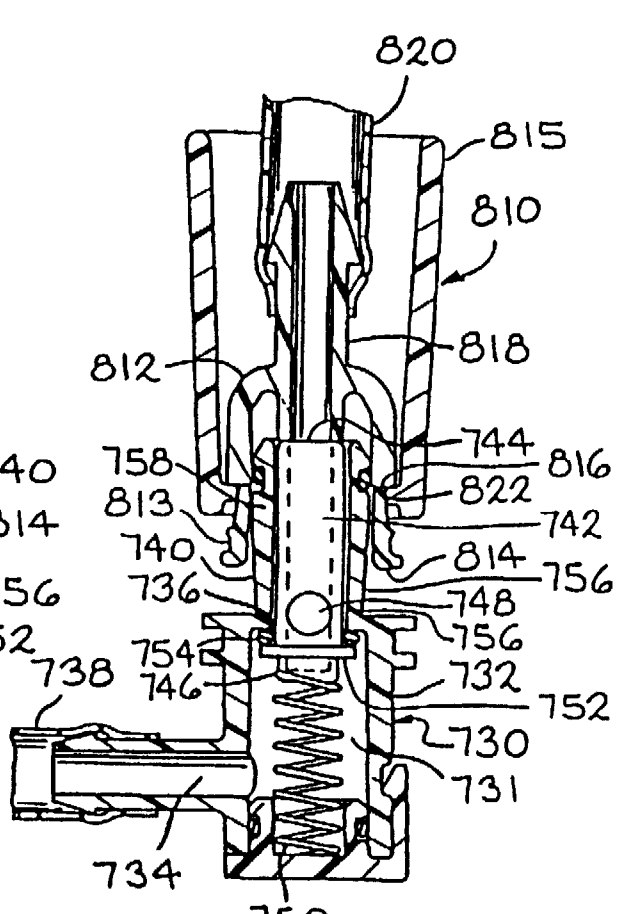
FIGS. 19 and 20 are cross-sectional views similar to FIG. 18 sequentially illustrating the removal of the solution supply coupling from the solution discharge valve.
Figure 19:
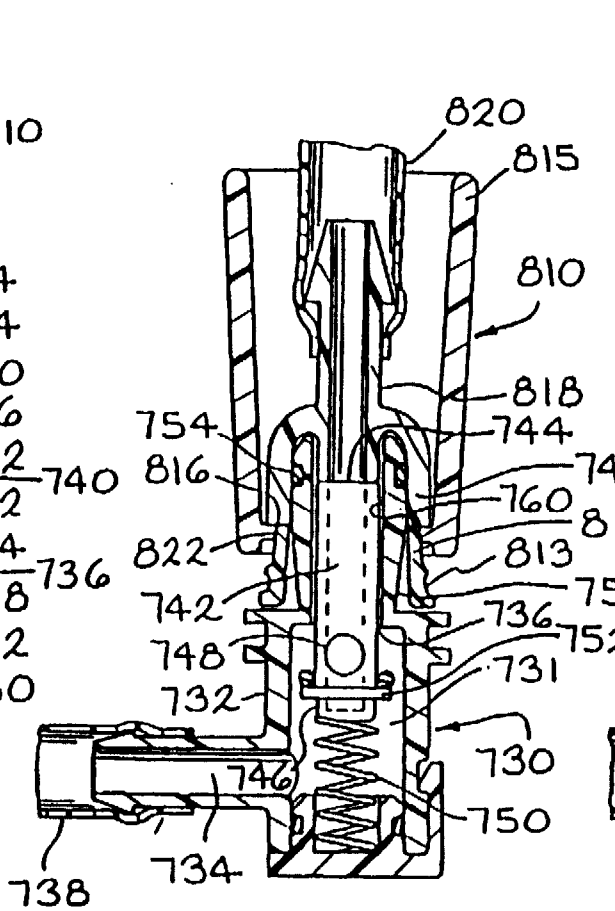
Figure 18:
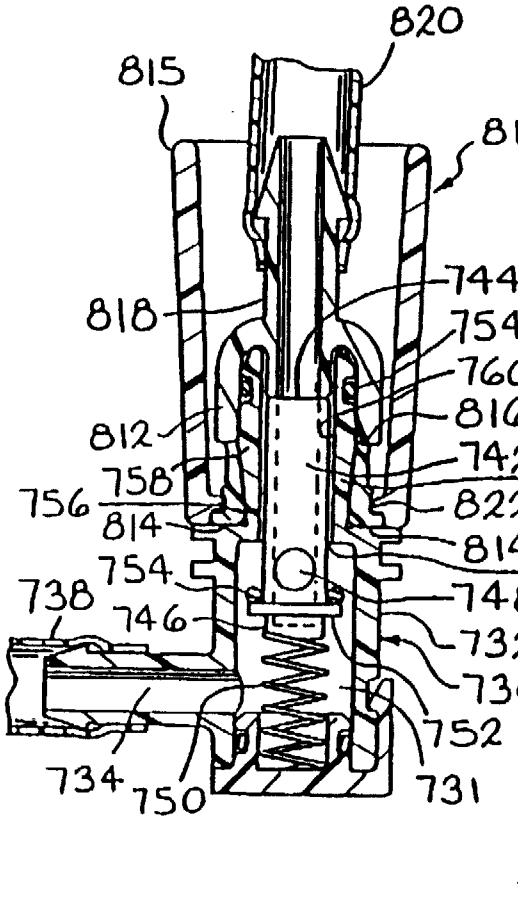
FIG. 18 is a cross-sectional view taken along line 18—18 in FIG. 17 illustrating the solution supply coupling attached to the solution discharge valve.

Turning now to FIGS. 18 through 20, the cleaning solution discharge valve 730 comprises a main body 732 having a side inlet 734 and an upwardly directed outlet 736. Inlet 734 fluidly communicates with the discharge port 272 of pump 250 via cross over tube 738 whereby pressurized cleaning solution is supplied to the main body 732. Integral with and extending vertically from main body 732 is discharge port 740 configured as a nipple for receiving thereon the cleaning solution supply hose quick disconnect coupling 810 further described below. Axially aligned within discharge nipple 740 is axially translatable valve member 742 having a hollow core open at the top end 744 thereof and closed at the bottom 746 and having at least one side opening 748. Compression spring 750 acting upon circumferential flange 752 of valve member 742 biases valve member 742 toward the normally closed configuration as illustrated in FIG. 20 thereby sealingly compressing O-ring 754 between the main body 732 and flange 752.

Removably attachable to discharge nipple 740 is quick disconnect coupling 810. Coupling 810 comprises a main cylindrical body 812 having at least two, preferably four, equally spaced axially extending fingers 814 hingedly attached to the peripheral rim 816 of the cylindrical main body 812. Fingers 814 are configured to have an increasing thickness diverging from peripheral rim 816 to the end thereof. Closing off the opposite end of main body 812 is an axially extending tubulet 818 to which upholstery nozzle supply hose 820 is attached. Tubulet 818 extends axially inside main body 812 providing a valve stem actuator 822 which when the main body 812 receives nipple 740 therein, axially aligns with valve stem 742 as illustrated. Circumscribing main body 812 of coupling 810 is a conically shaped locking collar 815 having an inwardly directed flange 822 circumscribing fingers 814.

When the main body 812 of coupling 810 is advanced downward over discharge nipple 740, as illustrated in FIG. 19, the valve member actuator 822 penetrates the nipple bore 760 forcing valve member 742 downward, compressing spring 750 to the extent that opening 748 of valve member 742 enters the main body chamber 731 of valve 730, thereby providing a fluid path through the valve member and tubulet 818 into supply hose 820 and on to upholstery nozzle 550. O-ring 754 sealingly engages nipple 740 and the main body 812 of coupling 810 as illustrated in the figures.

Coupling 810 is lockingly secured to discharge nipple 740 by advancing collar 815 downward over fingers 814, as illustrated in FIG. 18, thereby forcing the inside surface of fingers 814 into contact with the outside conical surface of nipple 740 thereby preventing removal of the coupling 810 from discharge nipple 740.

Fingers 814 of the coupling main body 812 are provided with detents 813 receiving therein flange 822 of collar 815, as illustrated in FIG. 18, thereby locking collar 815 and coupling 810 in the coupled configuration.

To remove coupling 810, collar 815 is axially withdrawn to the release position thereby releasing fingers 814 from nipple 740, as illustrated in FIG. 19, and axially removing coupling 810 from nipple 740. As is readily appreciated valve member 742 returns to its closed configuration, FIG. 20, as coupling 810 is removed by action of compression spring 750.

Referring now to FIGS. 2, 7, 8B, 15 and 24. The air turbine driven cleaning solution pump 210 is affixed to base frame 616, under hood 710 such that discharge exit 222, of the air turbine side of the assembly, aligns with and fluidly communicates with elbow duct 680 which fluidly communicates with the suction fan inlet plenum 619.

Hood 710 of nozzle assembly 70 overlies turbine pump 210 whereby the turbine air inlet 212 and the cleaning solution discharge nipple 740 of the attached solution discharge valve 730 are positioned within opening 765 in hood 710 thereby providing easy access to discharge valve 730 for attachment of the upholstery cleaning supply hose quick disconnect coupling 810 thereto. Trap door valve 766 is hingedly attached to opening 765 closing opening 765 when not in use. Valve door 766 is fitted, on the bottom side thereof, with a rectangular elastomeric seal 768 configured to engage and sealingly close inlet port 212 of air turbine 210 when door 766 is in the closed (floor cleaning mode) position.

Thus when extractor 10 is used in the floor cleaning mode, the air inlet port to air turbine 212 is sealed from the atmosphere by trap door valve 766 thereby preventing operation of the turbine pump assembly 210. However, when converted to the upholstery and/or stair cleaning mode, valve door 766 is opened, thereby opening turbine inlet port 212 to the atmosphere allowing air to flow through the air turbine 211 to the suction fan inlet plenum 619 thereby powering cleaning solution pump 250 and providing pressurized cleaning solution to upholstery nozzle 550 via supply tube 820 when coupling 810 is attached to discharge valve 730.

Figure 24:
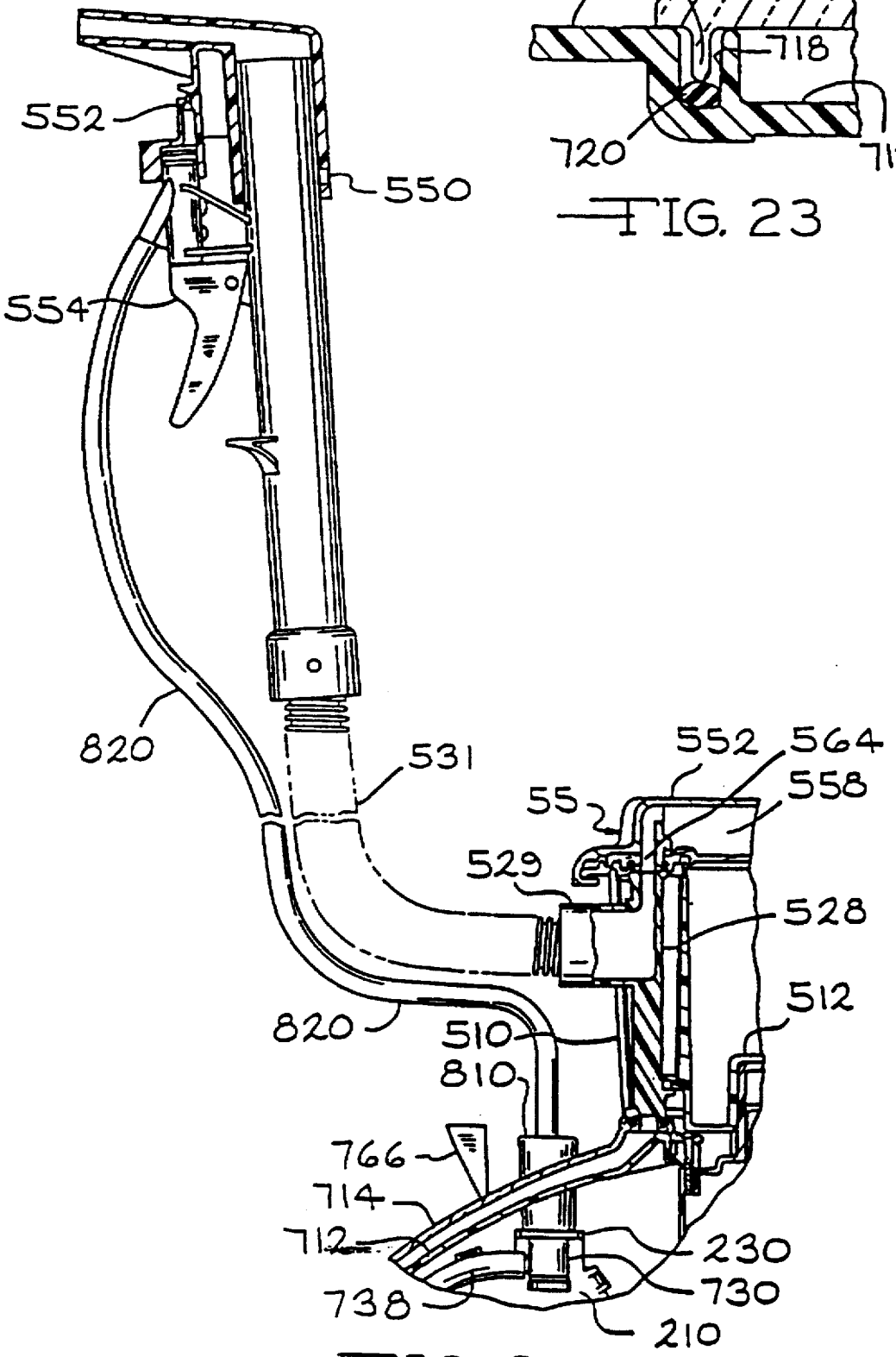
FIG. 24 is a partial sectional view, similar to FIG. 8B, showing the upright extractor converted to the above floor cleaning mode.
Figure 25:
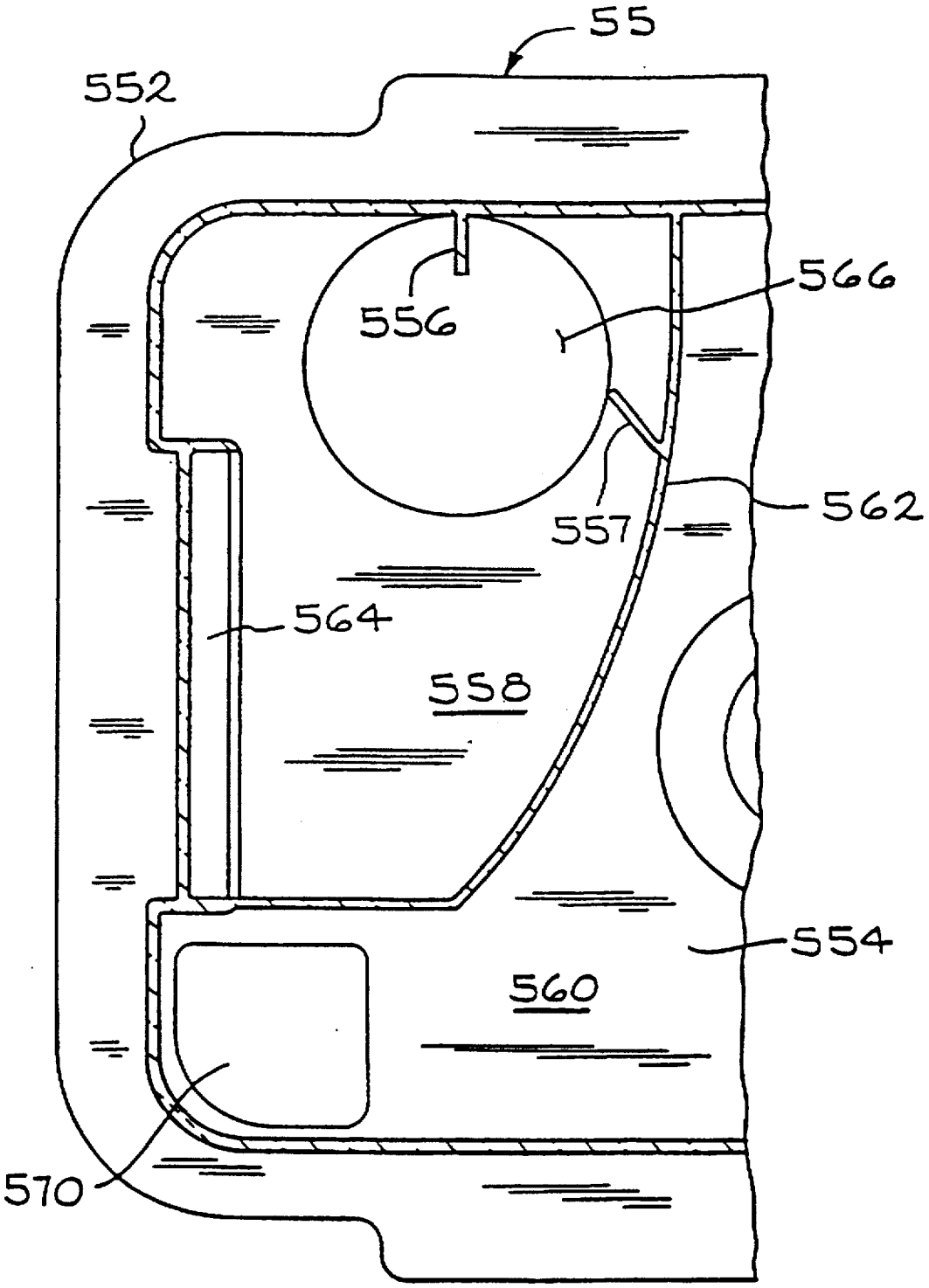
FIG. 25 is a cross-sectional view taken along line 25—25 in FIG. 8B.

Referring now to FIGS. 5, 8B and 24. The upright extractor 10 may be conveniently converted from the floor cleaning mode, as illustrated in FIG. 8B, to the above floor cleaning mode, as illustrated in FIG. 24. To affect the conversion, the operator removes the air/liquid separator lid assembly 55 from recovery tank 510 and withdraws floor module 526 from slot 530 in the forward wall of tank 510 and inserts the above floor module 528 having suction hose 531 fluidly attached to inlet port 529 thereof.

As best seen in FIG. 24, module 528 fluidly communicates with suction hose 531 thereby by passing floor nozzle 716. Fluidly attached to suction hose 531 is a typical hand operated upholstery/stair cleaning nozzle 550 having typical spray means 552 for dispensing cleaning solution upon the surface being cleaned. A typical on-off trigger operated valve 554 is provided to control the amount of solution dispensed. Pressurized cleaning solution is supplied to valve 554 via supply tube 820 connected to the turbine driven solution supply pump discharge valve 730 by quick disconnect coupling 810. Solution supply pump 210 typically supplies the cleaning solution at a pressure of at least 4 psia and preferably 6 psia.

In operation, the inlet plenum 619 of motor fan 610 fluidly communicates with recovery tank 50 via stand pipe 672 and 572 thereby creating a vacuum within tank 50. When extractor 10 is operated in the floor cleaning mode working air, including entrained fluid, is drawn into floor nozzle 70, through floor conversion module 526, air/fluid separator lid 55 and into the recovery tank 510. Warm, moist exhaust air, from motor fan 610, is discharged through discharge nozzle 65 and directed toward the surface being cleaned. Cleaning solution, upon the operator's command, is discharged from the cleaning fluid supply tank 40, passing through discharge valve 350, supply line 328, and into the fluid distributor 650 positioned within air discharge nozzle 65 whereby the cleaning fluid is atomizingly distributed throughout the discharged air and conveyed thereby to the surface being cleaned.

When extractor 10 is operated in the upholstery and/or stair cleaning mode, upholstery conversion adapter 528 replaces the floor cleaning adapter 526 thereby by passing floor nozzle 70 and fluidly connecting the intake port 564 of the air/water separator lid 55 with flexible hose 531. Thus working air, including entrained liquid, is drawn through upholstery nozzle 550, and into the air/water separator lid 55. Exhaust air, from motor fan 610, continues to be discharged from exhaust nozzle 65, however, solution supply valve 350 is closed thereby preventing the flow of cleaning fluid to fluid distributor 650.

In the upholstery cleaning mode, cleaning solution is supplied, under pressure, to upholstery nozzle 550 by the air turbine driven solution pump 250, the motive power driving pump 250 being supplied by air turbine 211. The suction port 222 of air turbine 211 fluidly communicates, via elbow duct 680, with the inlet plenum 619 of motor fan 610 while the intake port of the air turbine is open to the atmosphere via trap door valve 766. Valve door 766 is normally closed (carpet cleaning mode) thereby preventing the flow of atmospheric air thereto, thereby rendering turbine 211 inoperative. However, in the upholstery/stair cleaning mode valve door 766 is opened thereby activating turbine 211 (and solution pump 250) by permitting the flow of clean atmospheric air through the turbine to power pump 250. Thus, when in the upholstery/stair cleaning mode a steady pressurized flow of cleaning solution is supplied to upholstery nozzle 550. It is preferred that air turbine 211 and solution pump 250 be engineered to provide a cleaning solution flow rate of 0.10 gallons per minute at a pressure of between four to ten pounds psia.

Although the present invention has been described in connection with a preferred embodiment thereof, many variations and modifications will become apparent to those skilled in the art. It is preferred, therefore, that the present invention be limited not by the specific disclosure herein, but only by the following appended claims.

We claim:

1. In a carpet extractor having apparatus for applying cleaning fluid to the carpet surface; said apparatus comprising:

an air discharge nozzle having an elongate exhaust port through which a pressurized stream of air flows and is directed toward said carpet surface; and cleaning fluid distribution means, located within said nozzle, whereby cleaning fluid may be introduced into said stream of said flowing air and thereby transported to said carpet surface, said cleaning fluid distribution means comprising a body positioned within said nozzle such that a portion of said air stream flows over the top of said body and a portion flows underneath said body.

2. The apparatus as claimed in claim 1 wherein said body extends across the full width of said discharge nozzle thereby dividing said discharge nozzle into an upper airflow chamber atop said body and a lower air flow chamber below said body.

3. In a carpet extractor having apparatus for applying cleaning fluid to the carpet surface, said apparatus comprising:

a motor/fan assembly means for creating an exhaust airflow stream;

a first channel positioned substantially within a second channel;

means for directing said exhaust airflow stream through said second channel;

means for supplying cleaning fluid to said first channel.

4. The apparatus as claimed in claim 3 wherein said first channel is disposed within said second channel such that said exhaust airflow stream flows both over top of said first channel and beneath said first channel.

5. The apparatus as claimed in claim 3, wherein said first channel distributes said cleaning fluid substantially along the entire of width of said first channel.

6. The apparatus as claimed in 3, wherein said first channel is disposed such that said cleaning fluid mixes with said exhaust air flow stream when said cleaning fluid exits said first channel.

7. In a carpet extractor having an apparatus for applying cleaning fluid to a carpet surface, said apparatus comprising:

a motor/fan assembly for creating an exhaust air flow;

a first channel having an upstream end in fluid communication with said motor/fan assembly for receiving said exhaust air flow, an open downstream end defining an elongate exhaust port for directing said exhaust air flow toward a carpet surface, and an elongate cross-section extending transverse to the exhaust air flow in said first channel;

a cleaning solution reservoir for providing a source of cleaning solution;

a second channel having an upstream end in selective fluid communication with said reservoir for selectively receiving cleaning solution from said reservoir, a downstream end having at least one outlet port for emitting the received cleaning solution, and an elongate transverse cross-section, said second channel being located within said first channel whereby the emitted cleaning solution is mixed with said exhaust air flow and directed toward the carpet surface.

8. The apparatus according to claim 7, wherein said at least one outlet port is located adjacent to and upstream of said exhaust port.

9. The apparatus according to claim 8, wherein said second channel extends substantially across the full elongate transverse length of said first channel thereby dividing said first channel into a first air flow chamber to a first side of said second channel and a second air flow chamber to a second side of said second channel, such that said exhaust air flow flows over both said first side and said second side of said second channel.

10. The apparatus according to claim 9, wherein said exhaust port has a height normal to its elongate length that is less than a height of said first channel, whereby the exhaust air flow over said first side of said second channel and the exhaust air flow over said second side of said second channel merge downstream and adjacent to said at least one outlet port, such that said emitted cleaning solution is mixed with said exhaust air flow.

11. The apparatus according to claim 9, wherein said second channel has a transverse elongate length that is substantially equal to a transverse elongate length of said first channel.

12. The apparatus according to claim 11, wherein said downstream end of said second channel has a plurality of said outlet openings spaced along substantially the entire transverse elongate length of said downstream end of said second channel.

13. The apparatus according to claim 12, further comprising a plurality of flow dams extending downstream from said downstream end of said second channel.

14. The apparatus according to claim 13, wherein said flow dams are spaced along said downstream end of said second channel, such that one of said plurality of flow dams is located between each adjacent pair of outlet ports.

15. The apparatus according to claim 14, wherein said flow dams extend through said exhaust port.

16. The apparatus according to claim 12, further comprising a first nozzle lip extending inward from a first elongate side of said elongate exhaust port and a second nozzle lip extending inward from a second elongate side of said elongate exhaust port opposite said first side of said exhaust port, whereby said exhaust port has a height extending normal to the elongation of said exhaust port that is smaller than a height of said first channel, such that the exhaust air flow over said first side of the second channel and the exhaust air flow over said second side of said second channel merge downstream and adjacent to said downstream end of said second channel and mix with the cleaning solution emitted from said outlet openings.

17. The apparatus according to claim 16, wherein upstream surfaces of said nozzle lips are sloped.

18. A cleaning liquid discharge nozzle for a carpet extractor having a source of cleaning liquid and a motor/fan assembly having a suction side and an exhaust side, said discharge nozzle comprising:

spaced parallel first and second plates joined by side walls enclosing a plenum within said first and second plates and said side walls, said discharge nozzle having an upstream end in fluid communication with the exhaust side of said motor/fan assembly for receiving an exhaust air flow therefrom, an elongate cross-section, and an open elongate downstream end defining an elongate nozzle opening for discharging said exhaust air flow toward a carpet surface; and a cleaning solution distributor located within said plenum, said distributor having spaced and parallel top and bottom walls joined by end walls enclosing a cleaning liquid manifold having an elongate cross-section within said top, bottom and end walls of said distributor, said distributor further having an upstream edge wall and a downstream edge wall enclosing said manifold, an inlet fluidly communicating said manifold with the source of cleaning liquid and a plurality of fluid outlet ports spaced along said downstream edge wall fluidly communicating said manifold with said plenum within said discharge nozzle, whereby cleaning liquid is received in said manifold and emitted through said plurality of fluid outlet ports into said first plenum where it is mixed with the exhaust air flow in said plenum and discharged through said nozzle opening toward the carpet surface.

19. The apparatus according to claim 18, wherein said plurality of outlet ports are located adjacent to and upstream of said exhaust port.

20. The apparatus according to claim 19, wherein said cleaning solution distributor extends substantially across the full elongate cross-section of said nozzle thereby dividing said plenum into a first air flow chamber to a first side of said distributor and a second air flow chamber to a second side of said distributor.

21. The apparatus according to claim 20, wherein said nozzle opening has a height normal to its elongate length that is less than a height of said plenum, whereby the exhaust air flow over said first side of said distributor and the exhaust air flow over said second side of said distributor merge downstream and adjacent to said plurality of outlet ports, such that said emitted cleaning solution is mixed with said exhaust air flow.

22. The apparatus according to claim 20, further comprising a first nozzle lip extending inward from a downstream edge of said first plate and a second nozzle lip extending inward from a downstream edge of said second plate toward said first nozzle lip, whereby said elongate nozzle opening has a height extending normal to its elongate length that is smaller than a height of said plenum, such that the exhaust air flow over said first side of said distributor and the exhaust air flow over said second side of said distributor merge downstream and adjacent to said downstream edge of said distributor and mix with the cleaning solution emitted from said outlet openings.

23. The apparatus according to claim 22, wherein upstream facing surfaces of said nozzle lips are sloped.

24. The apparatus according to claim 18, further comprising a plurality of flow dams extending downstream from said downstream edge wall of said solution distributor.

25. The apparatus according to claim 24, wherein said flow dams are spaced along said downstream edge wall of said solution distributor, such that one of said plurality of flow dams is located between each adjacent pair of outlet ports.

26. The apparatus according to claims 25, wherein said flow dams extend through said nozzle opening.

* * * * *